US008584661B2

(12) United States Patent
Oppenheim

(10) Patent No.: US 8,584,661 B2
(45) Date of Patent: Nov. 19, 2013

(54) ARCHERY APPARATUS AND ARCHERY METHOD

(75) Inventor: Dov Oppenheim, Jerusalem (IL)

(73) Assignee: Oppenheim DOV Ltd., Jerusalem (IL)

( * ) Notice: Subject to any disclaimer, the term of this patent is extended or adjusted under 35 U.S.C. 154(b) by 221 days.

(21) Appl. No.: 13/083,684

(22) Filed: Apr. 11, 2011

(65) Prior Publication Data

US 2011/0259309 A1 Oct. 27, 2011

Related U.S. Application Data

(60) Provisional application No. 61/327,935, filed on Apr. 26, 2010.

(51) Int. Cl.
*F41B 5/00* (2006.01)

(52) U.S. Cl.
USPC ..... 124/88; 124/87

(58) Field of Classification Search
USPC ..... 124/23.1, 25.6, 86, 87, 88; 33/265
See application file for complete search history.

(56) References Cited

U.S. PATENT DOCUMENTS

| | | | | |
|---|---|---|---|---|
| 218,079 | A | | 7/1879 | Streeter |
| 3,171,397 | A | | 3/1965 | Daly |
| 3,182,651 | A | | 5/1965 | Huntley |
| 3,538,902 | A | * | 11/1970 | Fowkes ..... 124/88 |
| 3,599,621 | A | * | 8/1971 | Scrobell ..... 124/23.1 |
| 3,834,368 | A | | 9/1974 | Geiger |
| 3,849,894 | A | * | 11/1974 | Brougham ..... 33/265 |
| 4,457,287 | A | * | 7/1984 | Babington ..... 124/23.1 |
| 4,787,361 | A | | 11/1988 | Vyprachticky |
| 4,966,124 | A | * | 10/1990 | Burling ..... 124/23.1 |
| 4,996,968 | A | | 3/1991 | Hollingsworth |
| 5,081,979 | A | * | 1/1992 | Burling ..... 124/23.1 |
| 5,113,841 | A | | 5/1992 | Bratcher |
| 5,119,796 | A | | 6/1992 | Dehlbom |
| 5,205,268 | A | | 4/1993 | Savage |
| 6,079,111 | A | * | 6/2000 | Williams et al. ..... 33/265 |
| 6,216,681 | B1 | | 4/2001 | Dougherty et al. |

FOREIGN PATENT DOCUMENTS

| | | |
|---|---|---|
| FR | 2 723 189 A1 | 2/1996 |

* cited by examiner

*Primary Examiner* — John Ricci
(74) *Attorney, Agent, or Firm* — Nath, Goldberg & Meyer; Jerald L. Meyer

(57) ABSTRACT

The handgrip is inclined to one side of the bow's lengthwise axis—to the right for a right-handed archer and to the left for a left-handed archer. Thus in the firing position the hand holding the grip has its palm facing towards the ground. The hand grip also has a hemispherical thrust surface which fits into the hollow of the hand, and the arrow is fired from a position above the hand.

19 Claims, 11 Drawing Sheets

ARCHERY APPARATUS AND ARCHERY METHOD

This application claims the benefit of prior U.S. provisional patent application No. 61/327,935 filed date Apr. 26, 2010, the contents of which are hereby incorporated by reference in their entirety.

FIELD OF THE INVENTION

This invention relates to archery apparatuses, including archery bows, particularly risers and handles for archery bows, and to methods for archery, in particular methods for gripping and holding an archery bow and for shooting an archery bow.

BACKGROUND OF THE INVENTION

Archery bows are well known and include recurve bows, compound bows and longbows.

Such bows are held at the handles thereof by the support arm of the archer and the bowstring is drawn by the drawing arm, enabling the arrow to be aimed and shot by releasing the bowstring.

Conventionally, such bows comprise handles that are aligned with the longitudinal axis of the body of the bow, and in the shooting position the central plane of the bow is generally vertical, though in some cases the central plane is horizontal.

By way of general background, U.S. Pat. Nos. 3,182,651, 3,171,397, 218,079, 3,834,368, 4,787,361, 4,996,968, 5,113,841, 5,119,796, 5,205,268, FR 2,723,189, and U.S. Pat. No. 6,216,681 disclose a number of bow configurations.

SUMMARY OF THE INVENTION

According to a first aspect of the invention there is provided a bow riser for an archery bow, comprising a handle configured for enabling said bow riser to be held in a shooting position by a support hand of an archer, said riser comprising a longitudinal axis and having a first lateral side corresponding to a first side of the archer including the support hand, and a second lateral side corresponding to a second side of the archer including the drawing hand, the archery bow having a central plane associated therewith, said handle comprising a palm rest comprising a pivot zone and configured, at least during shooting with the bow, for enabling the palm of the support hand to be rested on said palm rest while concurrently enabling the fingers of the support hand to be fully open, and for transmitting bow loads with respect to the palm at said pivot zone; and wherein said riser is configured for placing an arrow in a shooting position in lateral facing relationship with said second lateral side.

The central plane of the archery bow may be defined for convenience as a plane including a first position and a second position of a centerline of the archery bowstring, the first position being when the bowstring is taught but undrawn, and the second position being when the bowstring is fully drawn and ready for shooting an arrow.

In at least some embodiments, the bow riser comprises a finger separating portion above said palm rest, said finger separating portion being generally aligned with a central plane of the bow, said finger separating portion being configured for laterally separating the fingers of the support hand into two groups when the palm of the support hand is rested on said palm rest, each said group including at least one finger other than the thumb of the support hand. Thus, the finger separating portion separates the fingers of the support hand into two groups as follows:

one group including the small finger of the support hand and the other group including the ring finger, the middle finger and the index finger of the support hand; or one group including the small finger and the ring finger of the support hand and the other group including the middle finger and the index finger of the support hand; or one group including the small finger, the ring finger and the middle finger of the support hand and the other group including the index finger of the support hand.

In such embodiments, said finger separating portion may be generally aligned with the central plane of the bow. The finger separating portion may be formed as a contiguous part of the bow riser.

In at least these embodiments or other embodiments of the invention, said palm rest is positioned generally centrally on said riser with respect to said first lateral side and said second lateral side.

In at least these embodiments or other embodiments of the invention, said pivot zone is positioned generally symmetrically with respect to the central plane of the bow.

In at least these embodiments or other embodiments of the invention, said palm rest is configured for aligning a back of the support hand with the support forearm to minimize or eliminate extension of the wrist of the support arm of the archer.

In at least these embodiments or other embodiments of the invention, said palm rest comprises a generally convex body projecting in a generally aft direction from the riser. In at least some such embodiments, at least a majority of said body projects in a generally aft direction with respect to said finger grips, and/or said body comprises an upper portion comprising upper facing contact surface having a profile that shallowly slopes in a downward and rearward direction when viewed from a side of the riser.

In at least these embodiments or other embodiments of the invention, the bow riser further comprises a first finger grip and a second finger grip, said finger grips extending laterally in mutually opposite directions with respect to the central plane, wherein in use, each said finger grip is configured for being independently gripped by a separate group of adjacent fingers of the bow support hand of an archer. In at least some such embodiments, the bow riser further comprises a finger crotch engaging portion, said finger crotch engaging portion being generally comprised on an aft longitudinal portion of said finger separating portion, wherein in use said crotch-engaging portion is engagingly abutting a crotch between said two groups of fingers in load bearing contact while each said finger grip may be concurrently gripped by a separate group of adjacent fingers of the bow support hand of an archer. Additionally or alternatively, said first finger grip is configured to be gripped by the small finger and ring finger of the support hand, and wherein said second finger grip is configured to be gripped by the middle finger and index finger of the support hand, and wherein a crotch between the middle finger and the ring finger is abuttingly engaged onto said finger crotch-engaging portion. Additionally or alternatively, said first finger grip is configured to be gripped by the small finger of the support hand, and wherein said second finger grip is configured to be gripped by the ring finger, middle finger and index finger of the support hand, and wherein a crotch between the middle finger and the ring finger is abuttingly engaged onto said finger crotch-engaging portion. Additionally or alternatively, said first finger grip is configured to be gripped by the small finger, ring finger and middle finger of the support hand, and wherein said second finger grip is configured to be gripped by the index finger of the support hand, and wherein a crotch between the middle finger and the ring finger is abuttingly engaged onto said finger crotch-engaging portion. Additionally or alternatively, said first finger grip and said second finger grip are generally cylindrical in form. Additionally or alternatively, said first finger grip and said second finger grip are co-aligned along an axis substantially orthogonal to said longitudinal axis. Additionally or alternatively, said first finger grip and said second finger grip are symmetrically disposed with respect to the central plane of the archery bow.

In at least these embodiments or other embodiments of the invention, the bow riser the bow riser may further comprising a sight arrangement for aiming the bow.

In at least these embodiments or other embodiments of the invention, the bow riser further comprises a vertical alignment arrangement configured for enabling repeatably tilting the central plane of the bow with respect to a desired vertical plane at a desired tilt angle. In such embodiments, said vertical alignment arrangement may comprise a visual indicator configured for providing a visual datum alignment axis to the archer, said visual indicator being configured for enabling said visual datum alignment axis to be selectively visually aligned with respect to said desired vertical plane by the archer, wherein said visual datum alignment axis is set at said desired tilt angle with respect to the central plane of the bow. Additionally or alternatively, said vertical alignment arrangement may be configured for enabling said desired tilt angle to be selectively varied within a range of said desired tilt angles. Additionally or alternatively, the bow riser may further comprise a sight arrangement for aiming the bow. For example, said sight arrangement may be mounted onto said riser via said vertical alignment arrangement, or said sight arrangement may be mounted onto said riser independently of said vertical alignment arrangement, or said sight arrangement may be integral with said vertical alignment arrangement.

In at least these embodiments or other embodiments of the invention, the bow riser may be configured for a right-handed archer and said second lateral side is the right side of said riser when facing forward, wherein the support hand is the left hand of the archer and said riser is configured for placing an arrow in a shooting position in lateral facing relationship with said right side of said riser. In such embodiments the bow riser may further comprise an arrow support on said right side of the riser for supporting an arrow in the shooting position. Alternatively, the bow riser may be configured for a left-handed archer and said second lateral side is the left side of said riser when facing forward, wherein the support hand is the right hand of the archer and said riser is configured for placing an arrow in a shooting position in lateral facing relationship with said left side of said riser; the bow riser may further comprise an arrow support on said left side of the riser for supporting an arrow in the shooting position.

According to this aspect of the invention there is also provided an archery bow, comprising a bow riser according to the first aspect of the invention as defined at least in connection with the first aspect of the invention. The archery bow may further comprising an upper limb and a lower limb attached to or integral with said riser.

According to the first aspect of the invention there is also provided a method for archery using an archery bow comprising the bow riser according to the first aspect of the invention.

According to a second aspect of the invention there is provided a tilt alignment apparatus for an archery bow, configured for enabling repeatably tilting a central plane of the archery bow with respect to a desired vertical plane at a desired tilt angle. In at least some embodiments of the invention, the tilt alignment apparatus comprises a visual indicator configured for providing a visual datum alignment axis to the archer, said visual indicator being configured for enabling said visual datum alignment axis to be selectively visually aligned with respect to the desired vertical plane by the archer, wherein said visual datum alignment axis is set at said desired tilt angle with respect to the central plane of the bow. Additionally or alternatively, said vertical alignment arrangement may be configured for enabling said desired tilt angle to be selectively varied within a range of said desired tilt angles. Additionally or alternatively, said vertical alignment arrangement may further comprise a sight arrangement for aiming the bow. For example, said sight arrangement may be mounted onto the archery bow via said vertical alignment arrangement, or said sight arrangement may be mounted onto the archery bow independently of said vertical alignment arrangement, or said sight arrangement may be integral with said vertical alignment arrangement.

According to this aspect of the invention there is also provided an archery bow, comprising a tilt alignment apparatus according to the second aspect of the invention and as defined at least in connection with the second aspect of the invention.

According to the second aspect of the invention there is also provided a method for archery using an archery bow comprising the tilt alignment apparatus according to the second aspect of the invention.

According to a third aspect of the invention there is provided a method for archery using an archery bow, the archery bow being configured to be held in at least during shooting by a support hand of an archer, the archery bow comprising a longitudinal axis and having a first lateral side corresponding to a first side of the archer including the support hand, and a second lateral side corresponding to a second side of the archer including the drawing hand, the archery bow having a central plane associated therewith, the method comprising:

(a) holding the archery bow with the holding hand and drawing the bowstring of the archery bow together with an arrow with the drawing hand to the fully drawn position, aiming and shooting the arrow;

(b) at least during shooting of the arrow, supporting bow loads with respect to the palm of the support hand via a pivot zone of a palm rest of the archery bow while concurrently maintaining open the fingers of the support hand;

(c) wherein at least in said fully drawn position, the arrow is in lateral facing relationship with the second lateral side of the archery bow.

According to at least some embodiments of the invention, the palm of the support hand is in generally orthogonal relationship to the central plane of the bow. Additionally or alternatively, said palm may be rested on the palm rest of the archery bow at a shallow angle with respect to a forearm of the support arm of the archer. Additionally or alternatively, the method may further comprise tilting the archery bow to provide a desired tilt angle between the central plane of the archery bow and a desired vertical plane, and maintaining said tilt angle at least during shooting of the arrow, wherein said tilt angle is greater than 0° and less than 90°. For example, the tilt angle may be any suitable acute angle in the range from about 1° to about 89°. For example, said tilt angle may be an angle between about 5° and about 85°, or between about 10° and about 75°, or between about 10° and about 60° or between about 10° and about 50° or between about 10° and about 45°, or between about 25° and about 35°. Additionally or alternatively, said vertical plane corresponds to a sagittal plane of the archer.

Additionally or alternatively, the archery bow according to the third aspect of the invention may comprise a finger separating portion above the palm rest, said finger separating portion being generally aligned with the central plane of the bow, and further comprising laterally separating the fingers of the support hand via the finger separating portion into two groups when the palm of the support hand is rested on said palm rest, each said group including at least one finger other than the thumb of the support hand. Additionally or alternatively, the method may further comprise placing at least one fingers of the support hand in tactile contact with the finger separating portion, and providing tactile feedback to the archer regarding at least a relative position and/or orientation of the archery bow with respect to the archer. Additionally or alternatively, the method may further comprise providing corrections to at least a relative position and/or orientation of the archery bow with respect to the archer by manipulating the archery bow via at least one finger of the support hand. Said at least one finger of the support hand includes at least one of the adjacent fingers of said two groups, said adjacent fingers including a finger of each said group that is adjacent a finger of the other said group. For example, the finger separating portion may separate the fingers of the support hand into two groups, and tactile feedback and/or tactile correction executed as follows:

- one group including the small finger of the support hand and the other group including the ring finger, the middle finger and the index finger of the support hand, tactile feedback and/or tactile correction being executed by one or both of the small finger and the ring finger; or
- one group including the small finger and the ring finger of the support hand and the other group including the middle finger and the index finger of the support hand, tactile feedback and/or tactile correction being executed by one or both of the ring finger and the middle finger; or
- one group including the small finger, the ring finger and the middle finger of the support hand and the other group including the index finger of the support hand, tactile feedback and/or tactile correction being executed by one or both of the middle finger and the index finger.

In at least some embodiments according to the third aspect of the invention, the archery bow may be configured for a right-handed archer and said second lateral side is the right side of said archery bow when facing forward, wherein the support hand is the left hand of the archer and said archery bow is configured for placing an arrow in a shooting position in lateral facing relationship with said right side of the archery bow. In such embodiments, a positive tilt angle is provided by tilting the upper part of the archery bow to the left of the archer, and the lower part of the archery bow to the right of the archer.

Alternatively, the archery bow may be configured for a left-handed archer and said second lateral side is the left side of the archery bow when facing forward, wherein the support hand is the right hand of the archer and the archery bow is configured for placing an arrow in a shooting position in lateral facing relationship with said left side of the archery bow. In such embodiments, a positive tilt angle is provided by tilting the upper part of the archery bow to the right of the archer, and the lower part of the archery bow to the left of the archer.

According to the third aspect of the invention, the archery bow may be the archery bow as defined for any one of the first or second aspects of the invention.

According to a fourth aspect of the invention there is provided a method for shooting an arrow with an archery bow, comprising tilting the archery bow to provide a desired tilt angle between the central plane of the archery bow and a desired vertical plane, and maintaining said tilt angle at least during shooting of the arrow, wherein said tilt angle is greater than 0° and less than 90°. For example, the tilt angle may be any suitable acute angle in the range from about 1° to about 89°. For example, said tilt angle may be an angle between about 5° and about 85°, or between about 10° and about 75°, or between about 10° and about 60° or between about 10° and about 50° or between about 10° and about 45°, or between about 25° and about 35°. Additionally or alternatively, said vertical plane corresponds to a sagittal plane of the archer.

Additionally or alternatively, the archery bow according to the fourth aspect of the invention may comprise a finger separating portion above the palm rest, said finger separating portion being generally aligned with the central plane of the bow, and further comprising laterally separating the fingers of the support hand via the finger separating portion into two groups when the palm of the support hand is rested on said palm rest, each said group including at least one finger other than the thumb of the support hand. Additionally or alternatively, the method may further comprise placing at least one fingers of the support hand in tactile contact with the finger separating portion, and providing tactile feedback to the archer regarding at least a relative position and/or orientation of the archery bow with respect to the archer. Additionally or alternatively, the method may further comprise providing corrections to at least a relative position and/or orientation of the archery bow with respect to the archer by manipulating the archery bow via at least one finger of the support hand. Said at least one finger of the support hand includes at least one of the adjacent fingers of said two groups, said adjacent fingers including a finger of each said group that is adjacent a finger of the other said group. For example, the finger separating portion may separate the fingers of the support hand into two groups, and tactile feedback and/or tactile correction executed as follows:

- one group including the small finger of the support hand and the other group including the ring finger, the middle finger and the index finger of the support hand, tactile feedback and/or tactile correction being executed by one or both of the small finger and the ring finger; or
- one group including the small finger and the ring finger of the support hand and the other group including the middle finger and the index finger of the support hand, tactile feedback and/or tactile correction being executed by one or both of the ring finger and the middle finger; or
- one group including the small finger, the ring finger and the middle finger of the support hand and the other group including the index finger of the support hand, tactile feedback and/or tactile correction being executed by one or both of the middle finger and the index finger.

According to the fourth aspect of the invention, the archery bow may be the archery bow as defined for any one of the first, second or third aspects of the invention.

A feature of at least one of the above first, second, third and fourth aspect of the invention is that by tilting the archery bow, the bow forces generated at least when shooting the arrow are balanced on each lateral side of the support arm of the archer, which facilitates control and manipulation of the archery bow.

A feature of at least some embodiments of the invention is that a clicker is not required for preventing the arrow from falling while drawing the bowstring, since the respective acute tilt angle of the bow with respect to the vertical plane, and the configuration of the riser that carries the arrow on an upper-facing side thereof, effectively prevents the arrow from falling.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

Figure 2:
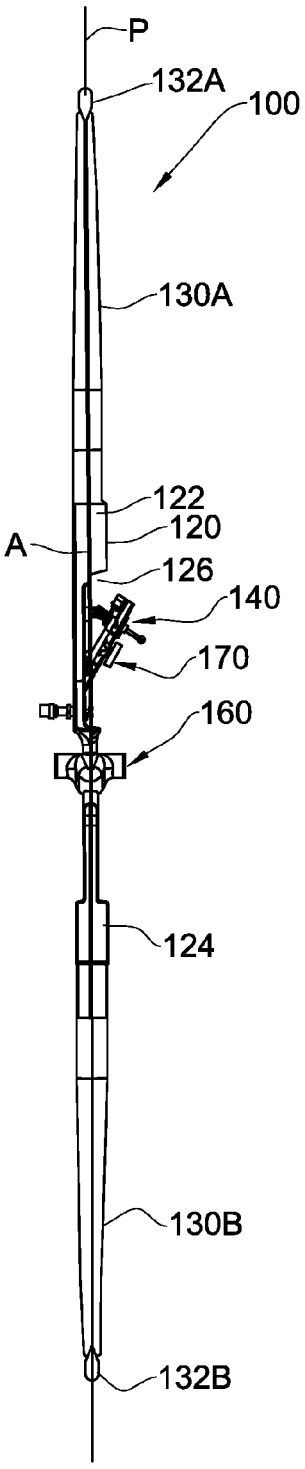
FIG. 2 is a front view of the embodiment of FIG. 1.
Figure 1:
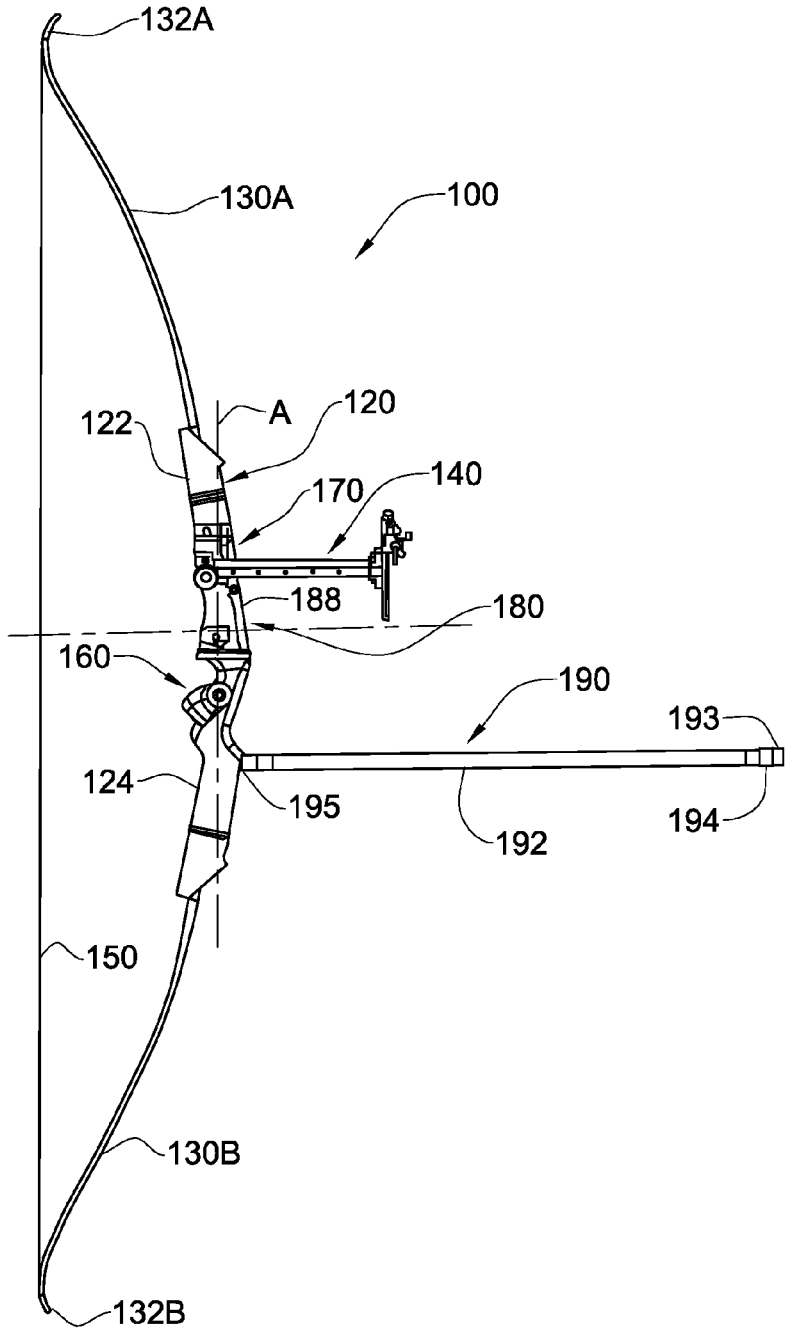
FIG. 1 is a side view of a bow according to a first embodiment of the invention.

Referring to FIGS. 1 to 6, an archery bow according to a first embodiment of the invention, generally designated 100, comprises a bow riser 120 (also referred to interchangeably herein as a riser, a central interconnecting member, or a central section), and an upper resilient bow limb 130A and a lower resilient bow limb 130B, each extending in longitudinally opposite directions from the riser 120. In this embodiment the bow 100 is configured as a recurve bow, and further comprises a bow string 150 suitably connected to the outer, free recurve ends 132A, 132B of the respective limbs 130A, 130B. While in this embodiment the limbs 130A, 130B are detachably mounted to the riser 120 in a suitable manner, for example via bolts, screws, snap-fit connections, and so on, in alternative variations of this embodiment one or both limbs may be formed integrally with the riser. The bowstring 150 comprises a center string serving 152 comprising a nock point 154, that engages with the nock 114 of an arrow 110 when the bow 100 is used therewith (see FIG. 6 in particular).

By way of non-limiting example, the riser 120 may be made from aluminium, magnesium or carbon, and/or the upper and lower limbs 130A, 130B may be made as composite elements, comprising an outer laminate (e.g., carbon fiber or fiber glass) and a wood or syntactic foam core, as is well known in the art. Alternatively, the riser 120 and/or the upper and lower limbs 130A, 130B may be made from any other suitable materials.

The riser is configured to be grasped and held by the support hand and support arm of the archer, and the bowstring is drawn by the archer's other hand and arm, herein referred to as the drawing hand and the drawing arm respectively.

According to the illustrated embodiment, the riser 120 is configured for a right-handed archer, and is thus selectively grasped and held by the left hand of the archer (which is thus the archer's support hand), and comprises an upper section 122 and a lower section 124, substantially co-linear with the longitudinal axis A of the riser 120. The riser also has a right side 122A and a left side 122B, as seen when looking in the forward direction.

Lower section 124 comprises handle 160 and a bow stabilizer arrangement 190, and upper section 122 comprises an arrow support arrangement 180, a sight arrangement 140, and a tilt alignment arrangement 170.

The longitudinal axis A may be defined, for convenience, as an axis on the plane of motion of the bowstring, also referred to herein as the central plane P of the bow 100, said axis A being along the elongate length dimension of the riser 120, and thus can be generally parallel to the string 150 in its unextended position (also referred to herein interchangeably as the undrawn position), for example. Central plane P (see FIG. 2) may be conveniently defined as the plane comprising the position of the centerline of bowstring 150 in its normally unextended (but nominally taught) position illustrated in FIG. 1 and also comprising the position of the centerline of bowstring 150 in its normally extended (ready to shoot) or drawn position. Axis A generally intersects a mid-portion of the riser 120.

Figure 4:
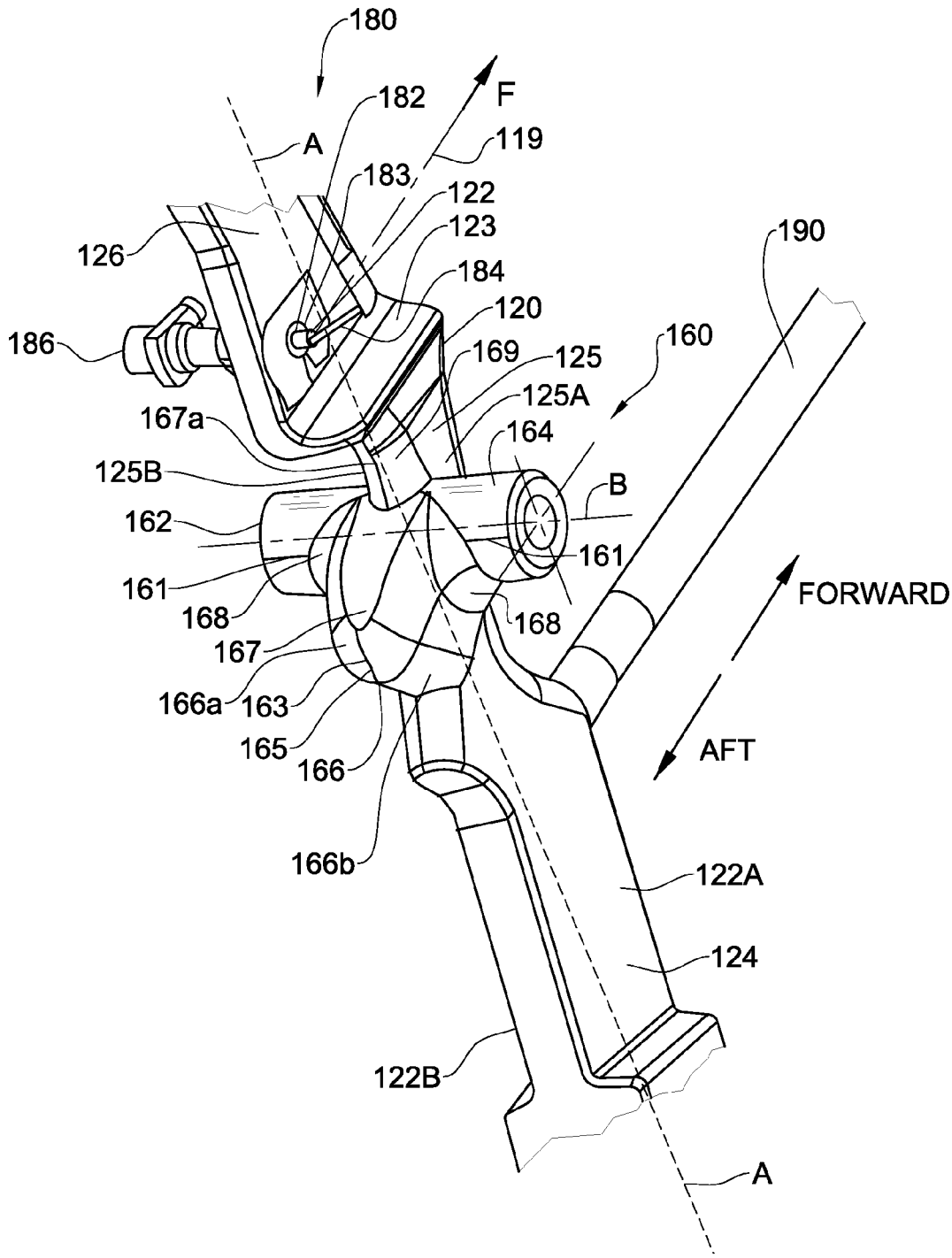
FIG. 4 is a partial isometric rear/top/right side view of the embodiment of FIGS. 1 to 3.
Figure 4A:
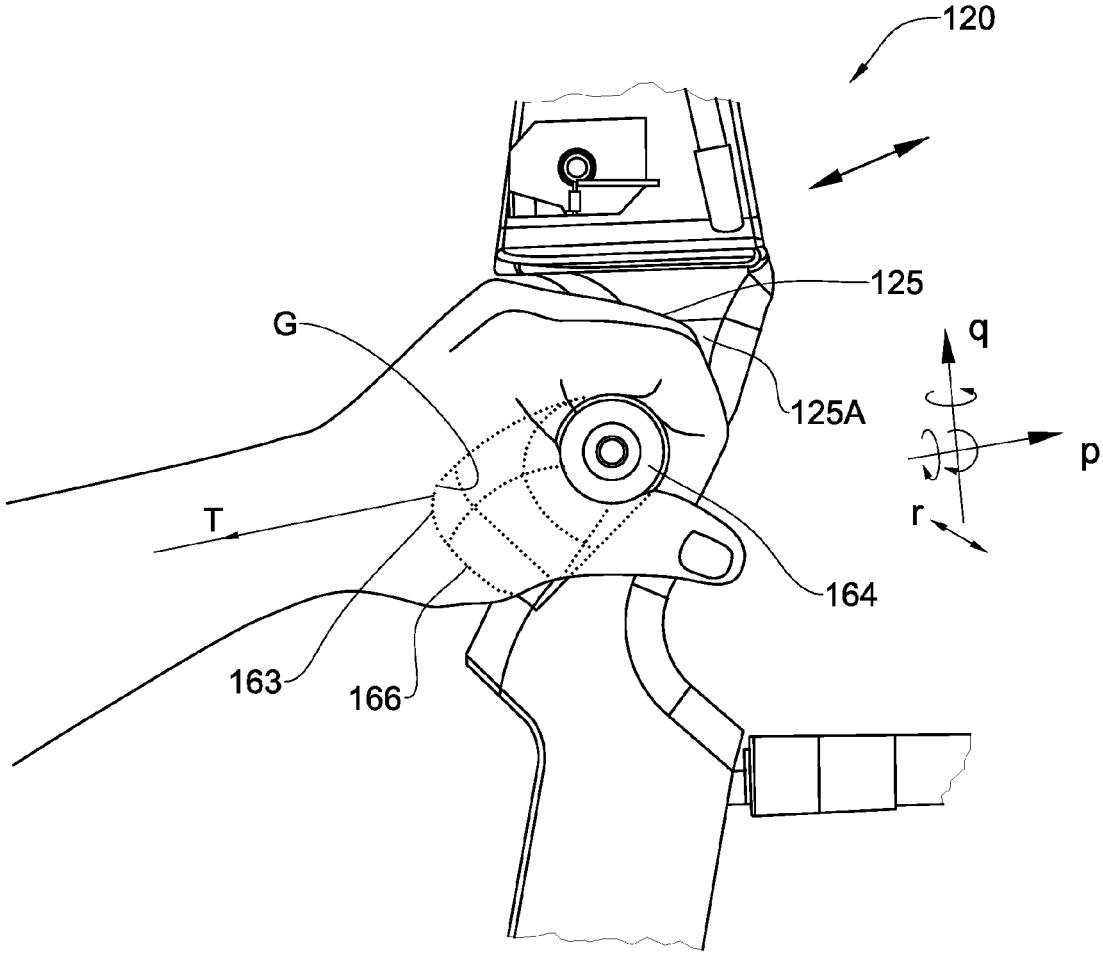
FIG. 4*a* is a partial side view of the embodiment of FIGS. 1 to 3, showing the relative position of the support hand of the archer in gripping position with respect to the handle.

Referring in particular to FIG. 4 and FIG. 4*a*, the riser 120 comprises gripping handle 160, also referred to herein interchangeably as handgrip or handle, configured to be selectively gripped, held and controlled, exclusively by one hand—the support hand—of the archer, in this embodiment by the left hand of the archer.

In particular, and as will become clearer herein, the handle is configured for providing the archer, at least during aiming and/or shooting the bow, with a pivot point formed and/or positioned with respect to the riser such as to allow the heel of the palm of the support hand to directly resist the bow loads in a generally palm-down position at this pivot point, and to transmit bow loads to the forearm, arm and shoulder in a generally direct and rectilinear manner, but substantially without introducing much torque at the wrist or elbow, if at all.

Furthermore, the handle is also configured for providing feedback tactile information to the archer regarding the relative position and/or orientation of the bow relative to the archer and/or relative to the desired position for shooting, in at least one degree of freedom, and may include two or three degrees of freedom, or more degrees of freedom. This allows the archer to "feel" that the archer is the required shooting position, which it is intended to be repeatable. Furthermore, the archer may also execute corrections to the position and/or orientation of the bow via the fingers of the support hand that are in tactile contact with the sides of the riser, in particular the finger separating portion of the riser.

In this embodiment, the handle 160 comprises two finger grips 162, 164, each extending laterally in mutually opposite directions from the riser 120 and in this embodiment are co-aligned along an axis B. Axis B is thus a transverse axis, substantially orthogonal to axis A, and may intersect axis A as illustrated in FIG. 4.

The finger grips are particularly configured for enabling the archer to grasp and manipulate the riser prior to and optionally until the bowstring 150 is fully drawn.

Finger grips 162, 164 are generally cylindrical in form in this embodiment, but in alternative variations of this embodiment, and/or in other embodiments, may have a different form, for example having an oval cross-section. The handle 160 is comprised on the upper portion of lower part 124 of the riser 120, and further comprises a crotch-engaging portion 169 inbetween and above the finger grips 162, 164.

In this embodiment, each one of the finger grips 162, 164 is configured for being gripped by a group of adjacent fingers (plus optionally the thumb). The finger of one such group that is adjacent to the finger of the other group are both referred to herein as "inner fingers". In this embodiment, each such group includes two respective adjacent fingers of the left hand of the archer: left hand finger grip 162 is thus configured to be gripped by the small and ring fingers, while right hand finger grip 164 is thus configured to be gripped by the middle and index fingers; and the inner fingers in this embodiment are the middle and ring fingers. The right hand grip 164 may also be grasped by the thumb of the support hand, for example as illustrated in FIG. 4*a*.

In alternative variations of this embodiment, the left hand finger grip 162 is configured to be gripped by the small, ring and middle fingers, while right hand finger grip 164 is configured to be gripped by the index finger (and optionally the thumb); and the inner fingers in this embodiment are the middle and index fingers.

In yet other alternative variations of this embodiment, the left hand finger grip 162 is configured to be gripped by small finger, while right hand finger grip 164 is configured to be gripped by the ring, middle and index fingers (and optionally the thumb); and the inner fingers in this embodiment are the ring and small fingers.

In alternative variations of this embodiment, the finger grips may be of different forms one from the other, and/or may be of different sizes one from the other, and/or may have non-aligned axes with respect to one another. In these or other alternative variations of this embodiment, the finger grips may be contoured and/or molded to provide a closer and/or more comfortable contact with the respective fingers of the support hand.

The crotch-engaging portion 169 is formed, in this embodiment, as part of the lower part 124 of the riser 120, above the location of finger grips 162, 164, and the crotch-engaging portion 169 is configured for engagingly abutting the crotch between the inner fingers at least when the archer's left hand grips the handle 160, and facilitates manipulation of the riser prior to and optionally until the bowstring 150 is fully drawn and released.

Thus, the grips 162, 164 are laterally spaced from one another by the thickness of the crotch-engaging portion 169, which thus forces the inner fingers (and correspondingly the two respective groups of fingers) to pivot away from each other in an abduction motion, when the archer's left hand grips the handle 160, and the two groups of fingers curl over and grip the respective grips 162, 164. At the same time, the aft edge 167*a* of the crotch-engaging portion 169 is closely aligned with (and typically slightly forward of) the aft edges 161 of finger grips 162, 164. This arrangement ensures that the crotch between the two inner fingers (for example, the crotch between the ring and middle fingers) of the support hand is firmly abutting the crotch-engaging portion 169 when the archer's left hand grips the handle 160, and thus facilitates manipulation of the bow by the support hand to the ready to shoot position, and subsequently enables at least a part of the bow forces generated during use of the bow 100 to be transmitted to, and to be resisted by, the support hand.

In alternative variations of this embodiment, the handle 160 may omit the finger grips 162, 164, and/or the crotch-engaging portion 169.

The handle 160 further comprises a palm abutment member 166 defining a pivot point 163, configured for enabling the forces generated by the bow, particularly during aiming and shooting, to be transmitted to and resisted by the archer, via the heel G of the palm of the support hand. In other words, these forces are focused at a single point (or zone) of contact, the pivot point 163. The relationship of these forces with respect to the archer may be controlled by varying the relative position and orientation between the bow and the archer at the pivot point. In this ready to shoot position, the support hand is not grasping the bow per se, but rather is holding it in position when the bowstring is drawn, by virtue of resistance of the bow forces by the archer at the heel of the palm of the support hand, and thus the fingers of the support hand may be in an open position and are not in any significant manner resisting these forces. Once the arrow is shot and the bow-induced forces are removed, the bow may fall from the support hand as there are no longer any forces pressing the palm abutment member 166 to the palm of the support hand.

The palm abutment member 166 has a generally convex form, particularly in the part thereof adjacent to pivot point 163, and is structurally and mechanically connected to the riser 120 as a rigid body.

The palm abutment member 166 comprises a palm rest 165 configured for resting the palm of the archer's support hand, and for transmitting loads from the bow 100 to the archer during use, in particular during aiming and shooting of the bow. The palm rest 165 is further configured for aligning the back of the support hand with the support forearm to minimize or eliminate extension of the wrist, and thus to minimize or eliminate torque on the wrist joint during use of the bow 100.

Figure 3:
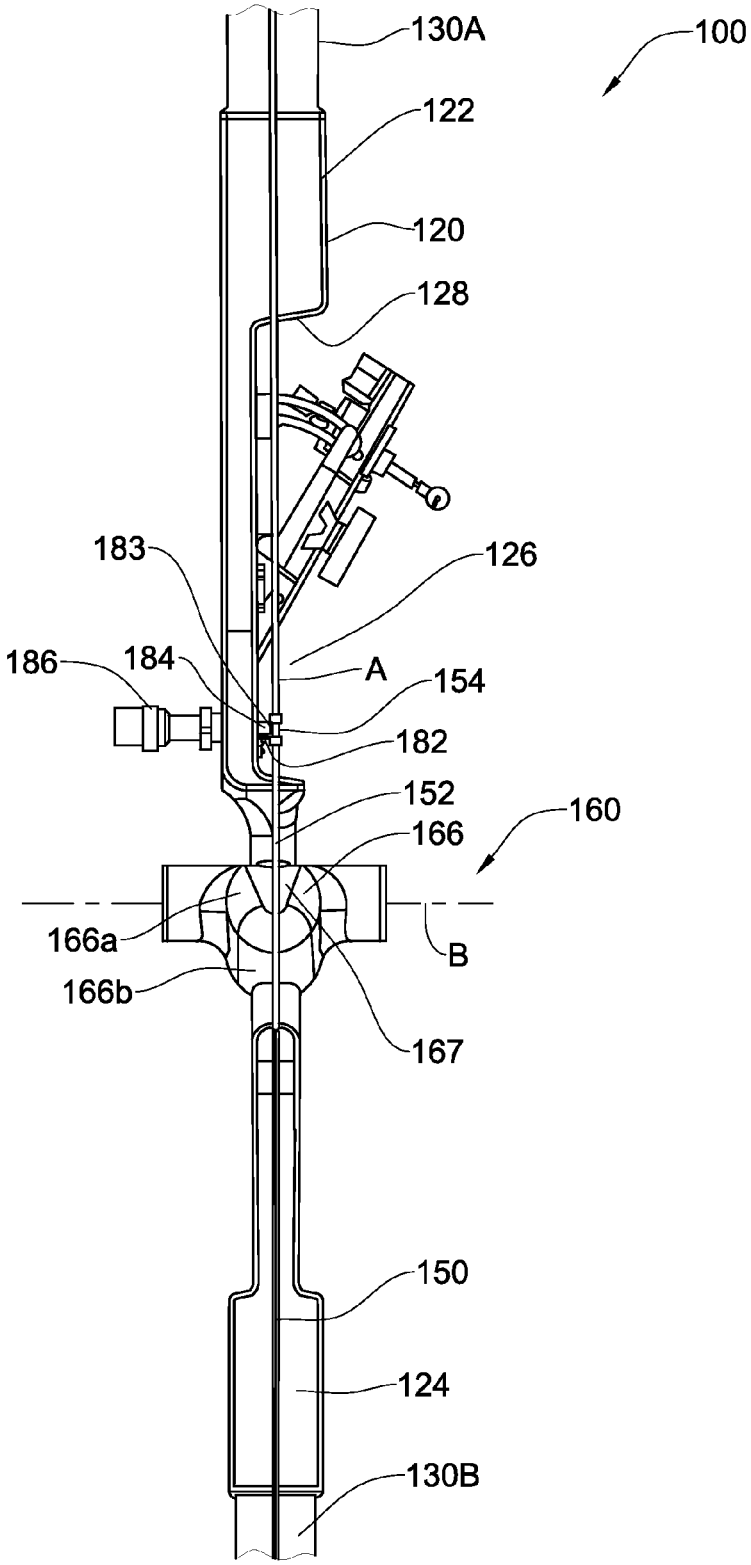
FIG. 3 is a partial rear view of the embodiment of FIGS. 1 and 2.

The palm abutment member 166 is in the form of a bulbous body projecting in a generally aft direction from the riser 120. At least a majority of the palm abutment member 166 projects in a generally aft direction with respect to the finger grips 162, 164. The upper facing contact surface 167 is thus formed on an upper portion 166*a* of the palm abutment member 166, and the upper portion 166*a* in this embodiment is generally convex, having a gently curved profile when viewed from the side (FIG. 1) and from the rear (FIG. 3). The contact surface 167 is thus configured for being symmetrical about the centrals plane P of the bow, but is otherwise generally complementary to the palm of the support hand, when this hand grasps or holds the handle 160, as will become clearer herein, and thus contact surface 167 is generally ergonomically compatible with the palm. Thus, in this embodiment the palm abutment member 166 is generally symmetrical about central plane P, and is generally centrally disposed with respect to the finger grips 162, 164.

In alternative variations of this embodiment, and in other embodiments, the contact surface of the body of the palm rest may be ergonomically tailored to the specific geometry of a particular's archer's hand, and optionally may be asymmetrical with respect to central plane P.

The palm abutment member 166 further comprises a lower portion 166*b* that structurally and mechanically connects the upper portion 166*a* to the riser 120, and thereby enables bow forces to be transmitted to, and to be resisted by, the user's palm via the upper portion 166*a*.

Saddle-shaped fairing portions 168 smoothly blend the contours of palm abutment member 166 at each lateral side thereof with the finger grips 162, 164.

It is to be noted that the profile of upper facing contact surface 167 gently curves from a near or actual horizontal slope at the forward end thereof, i.e., at base of the crotch-engaging portion 169, to a slope of acute angle near the aft end thereof, continuing to the generally convex shape of the aft end including the pivot point 163. This effectively provides a surface for the palm of the support hand to rest on, this surface being sloping gently downwards in a rearwards direction at a shallow angle, between about 10° and about 45° to the horizontal. In turn, this ensures that when the palm of the support hand rests on the upper facing contact surface 167 it will be generally aligned with the forearm, and the pivot point 163 is accommodated in the heel G of the palm, when the archer is in the ready to shoot position, as will become clearer below, thereby minimizing torque on the wrist, even when shooting the arrow.

In the ready-to-shoot position, i.e., after the bowstring is drawn, the archer may aim the bow and shoot the arrow. In this position, the fingers of the support hand are not, in general, grasping the finger grips, but rather are in a generally open position, with the heel of the palm resisting substantially all the bow forces which are transmitted thereto at the pivot point 163, as the thrust bearing contact point, via the palm abutment member 166.

A feature of at least this embodiment is that the palm abutment member 166 is formed with respect to the riser 120, such that a longitudinal control portion 125 of the riser 120 is laterally aligned with the fingers of the support hand and is in tactile contact with the inner fingers of the support hand. In other words, the two inner fingers are on either side of the control portion 125, each inner finger is in touching contact with a respective lateral side of the control portion 125. Thereby, the archer may feel the position and orientation of the bow when the bow's forces are being supported at the heel of the palm of the supporting hand by tactile feedback.

The control portion is also referred to interchangeably herein as the finger separating portion of the riser.

The control portion 125 is a part of the riser above the palm abutment member 166 having lateral faces 125A, 125B that are alignable and capable of providing tactile contact with the respective inner fingers of the support hand when these fingers are in the extended open position.

Referring to FIG. 4*a*, this tactile feedback may provide information to the archer regarding angular disposition or rotation of the riser 120 (and of the central plane P) with respect to at least one degree of freedom, for example rotations and/or translations with respect to at least one of three mutually orthogonal axes: a horizontal axis "p" defined on a vertical plane V; and/or a vertical axis "q" parallel to longitudinal axis A; and/or a lateral axis "r" parallel to axis B. In particular, engagement of the crotch between the two inner fingers and the crotch engaging portion 169 may further enhance the tactile feedback regarding angular disposition or rotation of the riser 120 (and of the central plane P) with respect to the lateral axis r. This tactile feedback may also be important during shooting of the arrow, and also after shooting of the arrow. For example, if releasing of the bowstring is not done properly this may induce a rotation to the riser, which may be felt by the archer via tactile feedback, and compensated for in the next shot.

The thumb of the supporting hand may also be used by the archer to enhance tactile feedback, in particular for angular disposition or rotation of the riser 120 (and of the central plane P) with respect to the horizontal axis, in conjunction with one or both of the inner fingers.

Furthermore, since there is a moment arm between the contact point of each of the inner fingers and the control portion 125 (and also between the contact point of the thumb and the control portion 125), and the pivot point 163, the archer may also manipulate the bow by means of these inner fingers, to thereby make relatively small corrections of the bow's position and/or orientation, when in the shooting position, with respect to the corresponding degrees of freedom, thereby further enhancing the archer's ability to aim and control the shooting of the bow.

Referring again to FIG. 1, the bow stabilizer arrangement 190 comprises a conventional center stabilizer arrangement, comprising a pole 192 that is connected at an aft end 195 thereof to the lower part 124, at a location below the handle 160, and projects therefrom in a forward direction generally aligned with the direction of flight F of the arrow, when this is shot with the bow 100. The forward end 193 of the pole 192 comprises a counter weight 194 that is chosen to dampen vibrations of the bow 100 about central plane P.

In alternative variations of this embodiment, and/or in other embodiments, the bow stabilizer arrangement may comprise a different arrangement to that of the illustrated embodiment.

In alternative variations of this embodiment, and/or in other embodiments, the bow stabilizer arrangement may be altogether omitted from the bow.

The upper section 122 is formed with a recess 126 on the right hand side 122A thereof, which is generally defined as the side of the riser that faces away from the support hand, the recess 126 comprising a longitudinal recess wall 127 having a laterally facing planar surface 129 substantially parallel to central plane P, but spaced in a leftward direction (with respect to the archer, when using the bow), a lower shelf 123 and an upper recess wall 128.

Figure 6:
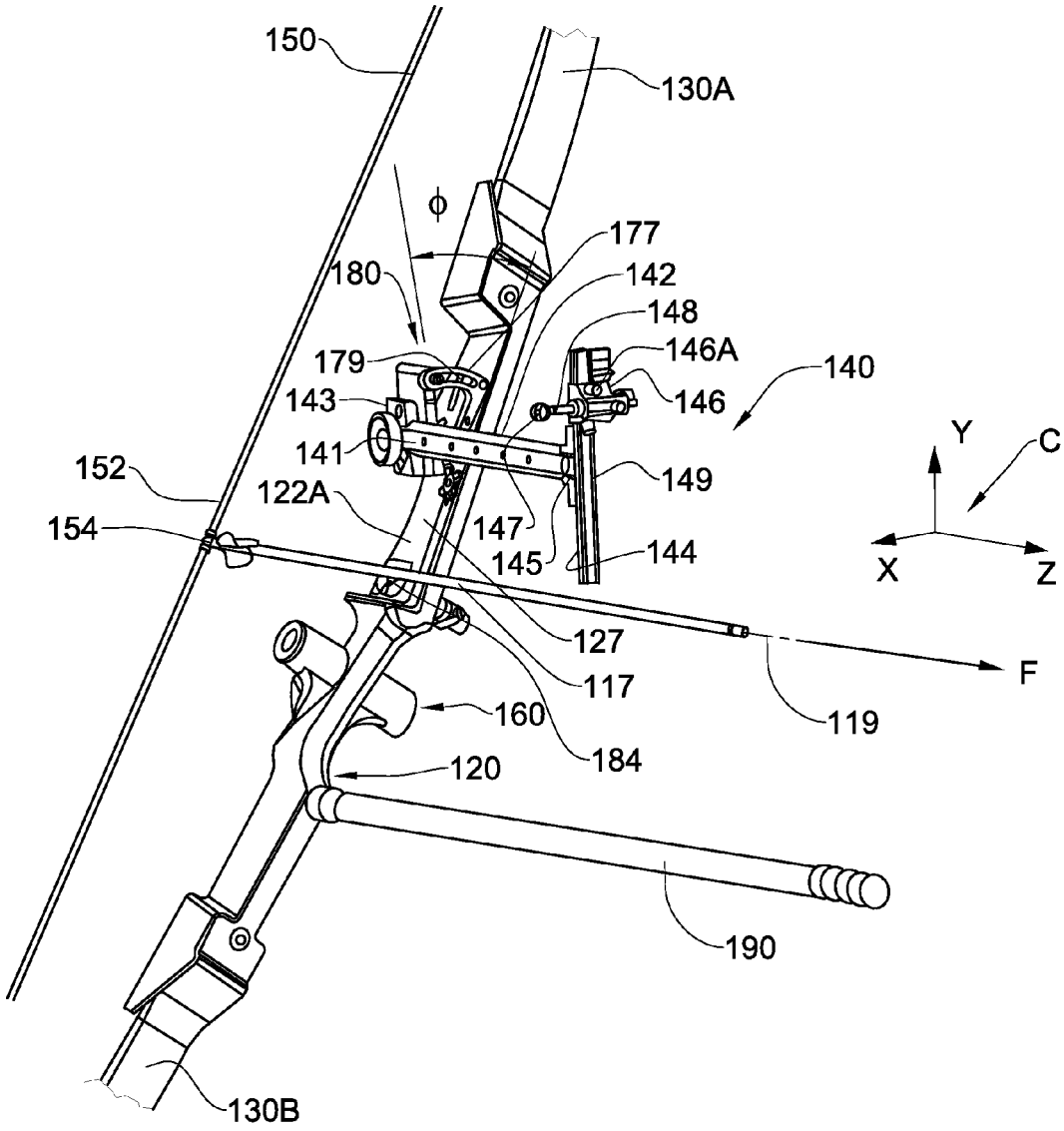
FIG. 6 is a partial isometric front/bottom/right side view of the embodiment of FIGS. 1 to 3.

Referring in particular to FIGS. 3 and 4, the arrow support arrangement 180 comprises a post 182 and an arrow rest 184. The arrow rest 184 is resilient and projects from surface 127 in a lateral rightward and forward direction (with respect to the archer, when using the bow), i.e., in a direction generally facing away from the support hand of the archer, in a position to support the arrow 110 from an underside thereof, as best seen in FIG. 6. The post 182 also projects from surface 127 in a lateral rightward direction (with respect to the archer, when using the bow), and engages via abutting end 183 a side of the arrow shaft 117 as it sits atop the rest 182, and ensures that the axis 119 of the arrow 110 is aligned with the central plane P. The post 182 is adjustable, and an adjustment mechanism 186 enables abutting end 183 to be moved laterally with respect to central plane P to thereby control the position of the arrow 110 with respect thereto. Furthermore, the post 182 is also spring loaded, and serves to dampen the amplitude of possible sideways motion of the arrow as it is released from the bow.

In alternative variations of this embodiment, and/or in other embodiments, the bow 100 may omit the arrow support arrangement 180, and additionally or alternatively, the lower shelf 123 of the recess may be configured for supporting the shaft 117 of an arrow 110 when positioned for shooting.

The bow further comprises a clicker 188 for performing a draw check; however, in alternative variations of this embodiment, and/or in other embodiments, the bow may omit the clicker.

Figure 5:
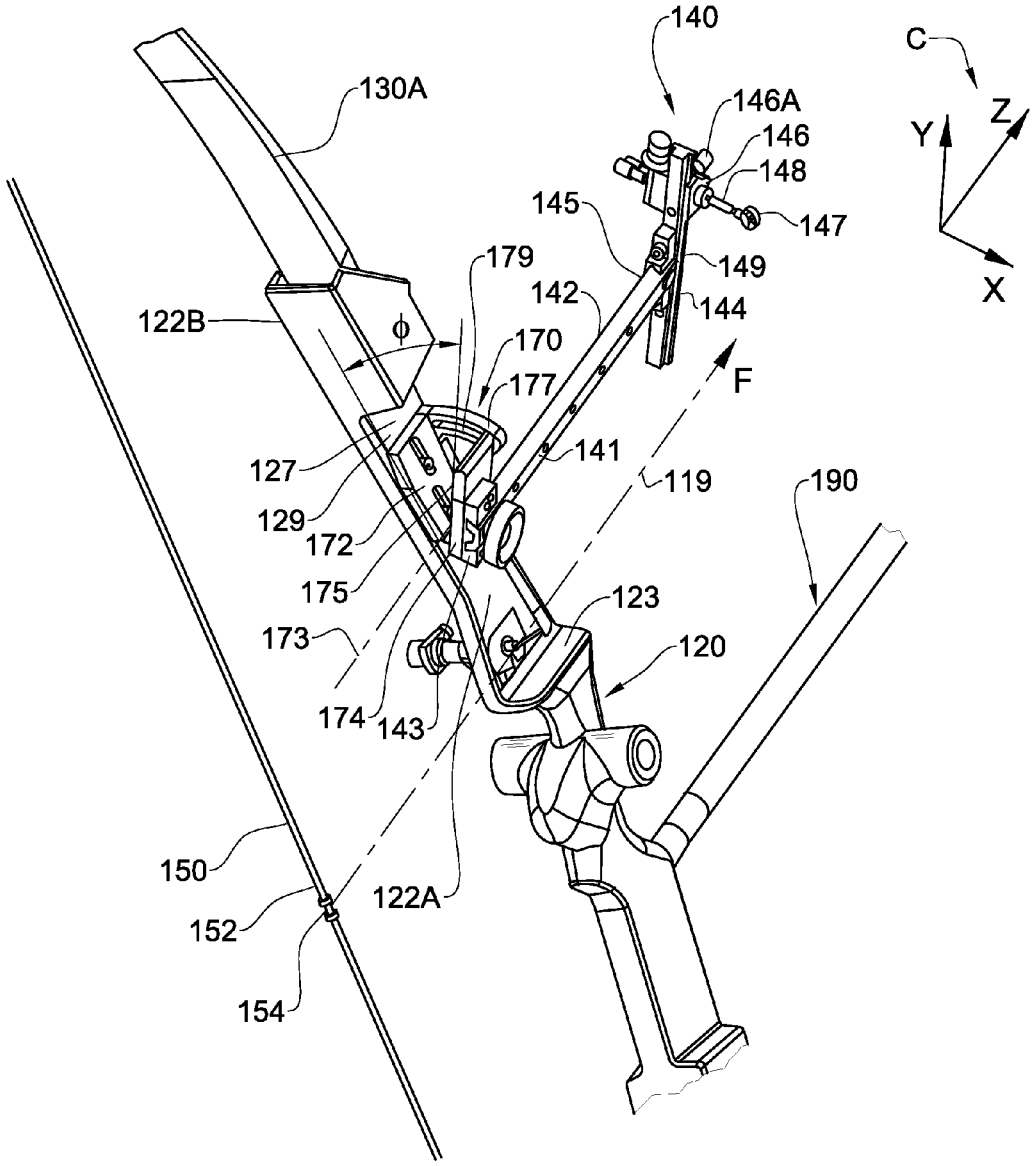
FIG. 5 is a partial isometric rear/top/right side view of the embodiment of FIGS. 1 to 4.

Referring in particular to FIGS. 5, and 6, the sight arrangement 140 can be based on conventional sight arrangements known in the art, and comprises a spacer arm 142, the aft end 141 thereof being affixed to the movable plate 174 of tilt alignment arrangement 170, via clamping arrangement 143, and the relative position therebetween with respect to the z-axis being adjustably variable by means of said clamping arrangement 143.

The position of sight 147 with respect to the movable plate 174 may be adjusted by the archer along one or more of three mutually orthogonal axes x, y and z of coordinate axes system C (which is a local coordinate system referred to the bow), as desired or required, within limits. Axis z is generally parallel to the path F, axis y is generally aligned with the vertical direction, and axis x is orthogonal to axes y and z and is generally in a horizontal direction (though not to be confused with horizontal direction H which is instead defined on the vertical plane V, which is parallel to the y-z plane).

The forward end 145 of spacer arm 142 comprises a rail member 149 aligned with the y-axis. A shuttle member 146 is movably mounted on said rail member 149, and the position of the shuttle member 146 may be fixedly adjusted with respect to the rail member 149, and thus with respect to the y-axis, by means of clamp 146A of the shuttle member 146.

The sight 147 is movably mounted to a transverse arm 148, which is mounted to and carried by shuttle member 146. The position of the transverse arm 148 may be fixedly adjusted with respect to the shuttle member 146, and thus with respect to the x-axis, by means of a suitable rail arrangement and clamp 146B of the shuttle member 146.

In alternative variations of this embodiment, and/or in other embodiments, the sight arrangement 140 may be mounted to the bow 100 in a manner that is independent of the tilt alignment arrangement 170. In other words, in such cases, the sight arrangement 140 may be mounted to a different part of the riser 120 than the tilt alignment arrangement 170, for example, and may remain mounted with respect to the riser 120, even if the tilt alignment arrangement 170 is removed from the riser 120. For example, the tilt alignment arrangement may comprise a line or axis etched, cut or marked on a transparent plate that may be mounted to the left side or right side of the riser 120, this line or axis being at the desired tilt angle with respect to the central plane P of the bow. Further, this tilt alignment arrangement may provide an adjustable tilt angle by providing the aforesaid line or axis in the form of a radial marker that is pivotable about an axis parallel to the z-axis, and the angular position of the radial marker on the transparent plate is correlated to the tilt angle.

In alternative variations of this embodiment, and/or in other embodiments, the bow may omit the sight arrangement and/or the tilt alignment arrangement, and thus aiming of the bow with respect to a desired target and/or tilting of the bow with respect to a desired vertical plane may be accomplished by simple visual estimation.

Figure 7:
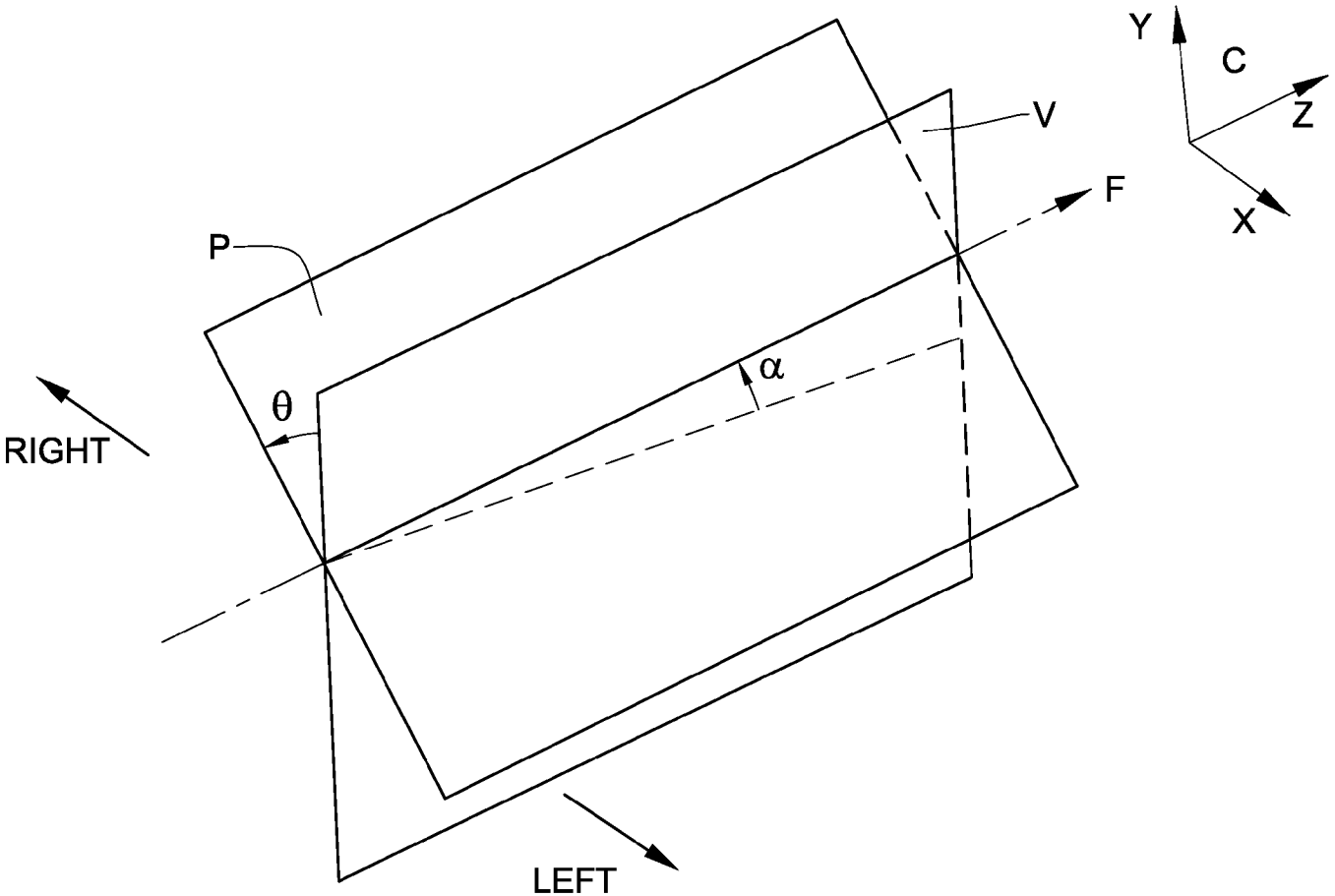
FIG. 7 schematically illustrates geometric relationship between the central plane P of the embodiment of FIGS. 1 to 6 and a vertical plane V.

Referring in particular to FIGS. 5, 6 and 7, the tilt alignment arrangement 170 is configured for enabling the archer to accurately and repeatably tilt the central plane P of the bow at a desired angle θ with respect to a vertical plane V for shooting an arrow along a desired path F nominally on this vertical plane V. In the illustrated embodiment, where the bow 100 is configured as a right-handed bow in which the riser 120 is to be grasped by the left hand of the archer, the bow is tilted by angle θ such that the upper end 132A is displaced relatively to the left, while the lower end is displaced relatively to the right, (with respect to the archer, when using the bow), and thus angle θ is measured as the anticlockwise tilting of the central plane P with respect to vertical plane V when viewed by the archer using the bow 100. Vertical plane V may be defined as a vertical plane that is aligned with the shaft of the arrow 110 when this is in the ready to shoot position with respect to the bow.

Thus, and referring in particular to FIG. 7, for convenience the vertical plane V may be chosen such that the intersection of plane P with vertical plane V is along path F, which is of course aligned with the axis 119 of the arrow 110 when this is in the ready to shoot position with respect to the bow 100. Path F may be tilted with respect to a horizontal direction H, defined on the vertical plane V, by an elevation angle α. In one particular example, angle α may be zero, and thus path F is initially aligned with the horizontal direction H.

The tilting of the bow, and thus the central plane P, by an acute angle θ effectively minimizes or eliminates any moments induced by the bow forces on the support arm by dividing these forces into two, to thereby generate two generally equal moments on either lateral side of the support arm, which more-or-less balance out in the lateral direction. Accordingly, less effort is required by the archer to balance the bow along the lateral direction when in the ready to shot position, as compared with shooting the bow with a zero tilt angle θ, facilitating aiming and shooting of the arrow.

Furthermore, by having the arrow resting on the upper-facing right side 122A of the riser, i.e., on the side of the riser that faces away from the support arm of the archer and towards the drawing arm of the archer, slap of the bowstring on the support arm or support hand after the bowstring 150 is released is minimized or eliminated, while holding the bow substantially at the central plane P.

Referring again to FIGS. 5 and 6, the tilt alignment arrangement 170 is configured for facilitating for the archer tilting of the central plane at an adjustable tilt angle θ, and comprises a bracket base 172, configured for being attached to the planar surface 129 of the recess wall 127 of recess 126, and the movable plate 174 which is pivotably mounted to bracket base 172 about pivot axis 173, which is substantially parallel with respect to path F.

The sight arrangement 140 is mounted to the movable plate 174 so that it moves with the movable plate 174 as a rigid body. The sight arrangement 140 is mounted on the right hand side 122A of the riser, which faces in a generally upward direction when the bow is tilted in a positive angle θ.

In particular, the rail member 149 has at least one longitudinal edge 144 that is aligned with the movable plate 174 and is substantially orthogonal to pivot axis 173. This longitudinal edge 144 may be used as a vertical datum to be aligned with the vertical plane V by the archer when aiming and shooting with the bow. Thus, when the bracket angle Φ between the bracket base 172 and the movable plate 174 is zero, the longitudinal edge 144 is effectively aligned with or is parallel to the central plane P of the bow, when seen along a direction parallel to path F. As the movable plate 174 is rotated about axis 173 to provide an acute bracket angle Φ between the bracket base 172 and the movable plate 174, correspondingly the longitudinal edge 144 is angularly displaced from the central by a tilt angle θ that is equal to the bracket angle Φ, when seen along a direction parallel to path F.

Thus, by setting the bracket angle Φ to be equal to a desired tilt angle θ, and then aligning the longitudinal edge 144 with the desired vertical plane V, the central plane P of the bow 100 is automatically tilted to tilt angle θ with respect to this vertical plane V.

As already mentioned, the bracket angle Φ may be set by angularly displacing the movable plate 174 with respect to bracket base 172 about pivot axis 173. A locking arrangement 176 locks the tilt alignment arrangement 170 at this angle, and comprises in this embodiment an arcuate bracket 177 affixed to bracket base 172 substantially orthogonal thereto and having an arcuate slot 179 centered on axis 173, and a pin 178 projecting from the forward end of alignment plate 174 and received in said slot 179. Thus, as movable plate 174 pivots with respect to bracket base 172, pin 178 moves along slot 179, and when the desired bracket angle Φ is achieved, the movable plate 174 may be locked in position with respect to bracket base 172 by means of locking nut 171 that effectively clamps the arcuate bracket 177 between the movable plate 174 and the nut 171.

Optionally, the arcuate bracket 177 may be marked with graduations marking specific angular intervals (not shown) to facilitate setting the desired bracket angle Φ and thus the desired tilt angle Φ. Alternatively, other methods may be employed to provide a desired bracket angle Φ—for example, desired bracket angle Φ may be set by sight estimation only, or by temporarily placing a mechanical wedge (having a wedge angle at the desired bracket angle Φ) between the movable plate 174 and the bracket base 172.

In the illustrated embodiment, the tilt angle θ may be varied from zero degrees to about 35° or up to about 45°, but may be greater or less than this upper value. For example, with a standard bow longitudinal length of about 1.30 meters and a tilt angle θ of about 32°, the free ends of the bow are laterally separated by about 80 cm, which correlates with the minimum spacing between adjacent archers according to FITA rules.

In alternative variations of this embodiment, and/or in other embodiments the tilt alignment arrangement may be configured for enabling the tilt angle θ to be varied between zero degrees to less than 90°.

In use, the archer may adjust the bracket angle Φ until a tilt angle θ is reached which minimizes the moment on the support arm when the bow is in the ready to shoot position, or when the tilt angle θ which provides a comfortable load on the support arm, while maintaining the free ends of the bow laterally displaced within desired limits, and then sets the angle bracket at the corresponding bracket angle Φ. Once the bracket angle Φ is set for a particular archer, it need not be changed again until the archer wishes to do so, or when the archer is to be used by a different archer having a different preference for the tilt angle.

In alternative variations of this embodiment, and/or in other embodiments, the tilt alignment arrangement may be mounted on the left hand side 122B of the riser, which faces in a generally downward direction when the bow is tilted in a positive angle θ, mutatis mutandis.

The sight arrangement 140 comprises a sight 147, which in this embodiment comprises a generally annular member, the open center of which is visually aligned with the target by the archer when the archer is aiming the bow at the target. In alternative variations of this embodiment, and/or in other embodiments, though, the sight may additionally or alternatively comprise cross-hairs, magnification lenses, and so on, as in known in the art.

In alternative variations of this embodiment, and/or in other embodiments, the tilt alignment arrangement may be non-adjustable, i.e., fixed, and thus provides a fixed tilt angle θ, i.e., enables a fixed tilting of the bow's central plane to be achieved by aligning a suitable datum surface of the bow, such as for example the aforementioned longitudinal edge 144, in the vertical direction. Thus, the tilt alignment arrangement 170 may be replaced with a non-adjustable wedge having a wedge angle corresponding to the desired bracket angle Φ (and thus tilt angle θ), and thus, alignment of the longitudinal edge 144 with the vertical plane V ensures that the central plane P is the corresponding tilt angle θ to the vertical plane V. The wedge may be configured for enabling the sight arrangement 140 to mounted thereby to the right hand side 122A of the riser, which faces in a generally upward direction when the bow is tilted in a positive angle θ, or alternatively the wedge may be configured for enabling the sight arrangement 140 to mounted thereby to the left hand side 122B of the riser, which faces in a generally downward direction when the bow is tilted in a positive angle θ.

In alternative variations of this embodiment, and/or in other embodiments, the tilt alignment arrangement may be integrally formed with the riser 120, for example in the form of a wedge-like protrusion on a lateral side of the riser. Thus, when the sight arrangement 140 is mounted to the integral wedge protrusion, the relative position of the sight arrangement 140 is such that alignment of the longitudinal edge 144 with the vertical plane V ensures that the central plane P is the corresponding tilt angle θ to the vertical plane V. The integral wedge may be formed on the right side 122A of the riser to enable the sight arrangement 140 to mounted thereby to the right hand side of the riser, which faces in a generally upward direction when the bow is tilted in a positive angle θ, or alternatively the wedge may be formed on the left side of the riser to enable the sight arrangement 140 to mounted thereby to the left hand side 122B of the riser, which faces in a generally downward direction when the bow is tilted in a positive angle θ.

Alternatively, the sight arrangement 140 may be suitably mounted to a forward edge of the riser.

Alternatively, it may only be necessary to provide a datum vertical surface or edge on the bow that may be alignable with the vertical plane V, wherein this datum vertical surface is at the fixed tilt angle θ with respect to the central plane P of the bow, and such that when this datum vertical surface is aligned with vertical plane V, the axis 119 of the arrow is aligned on this vertical plane V, or at least in another vertical plane that is parallel to this vertical plane V, and the central plane P is automatically tilted at tilt angle θ to the vertical. For example, the upper recess wall 128 may be set and the desired angle θ to planar surface 129 of the recess 126, and thus this angled upper recess wall provides such a datum vertical surface.

In one particular alternative variation of the embodiment illustrated in FIGS. 1 to 6, an integrated assembly is provided for the sight arrangement and the tilt alignment arrangement.

Figure 8:
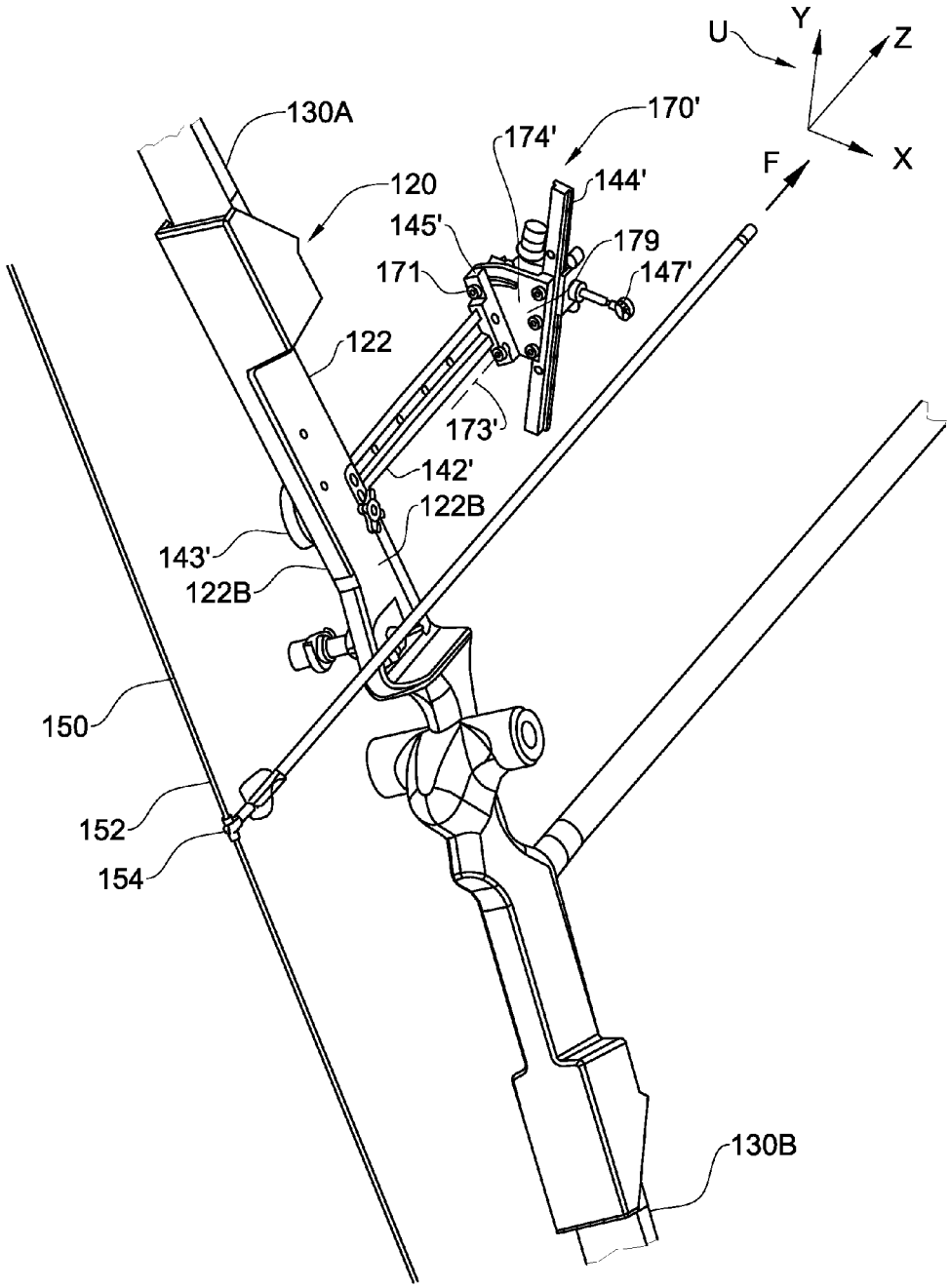
FIG. 8 is a partial isometric rear/top/right side view of an alternative variation of the embodiment of FIGS. 1 to 6.
Figure 9:
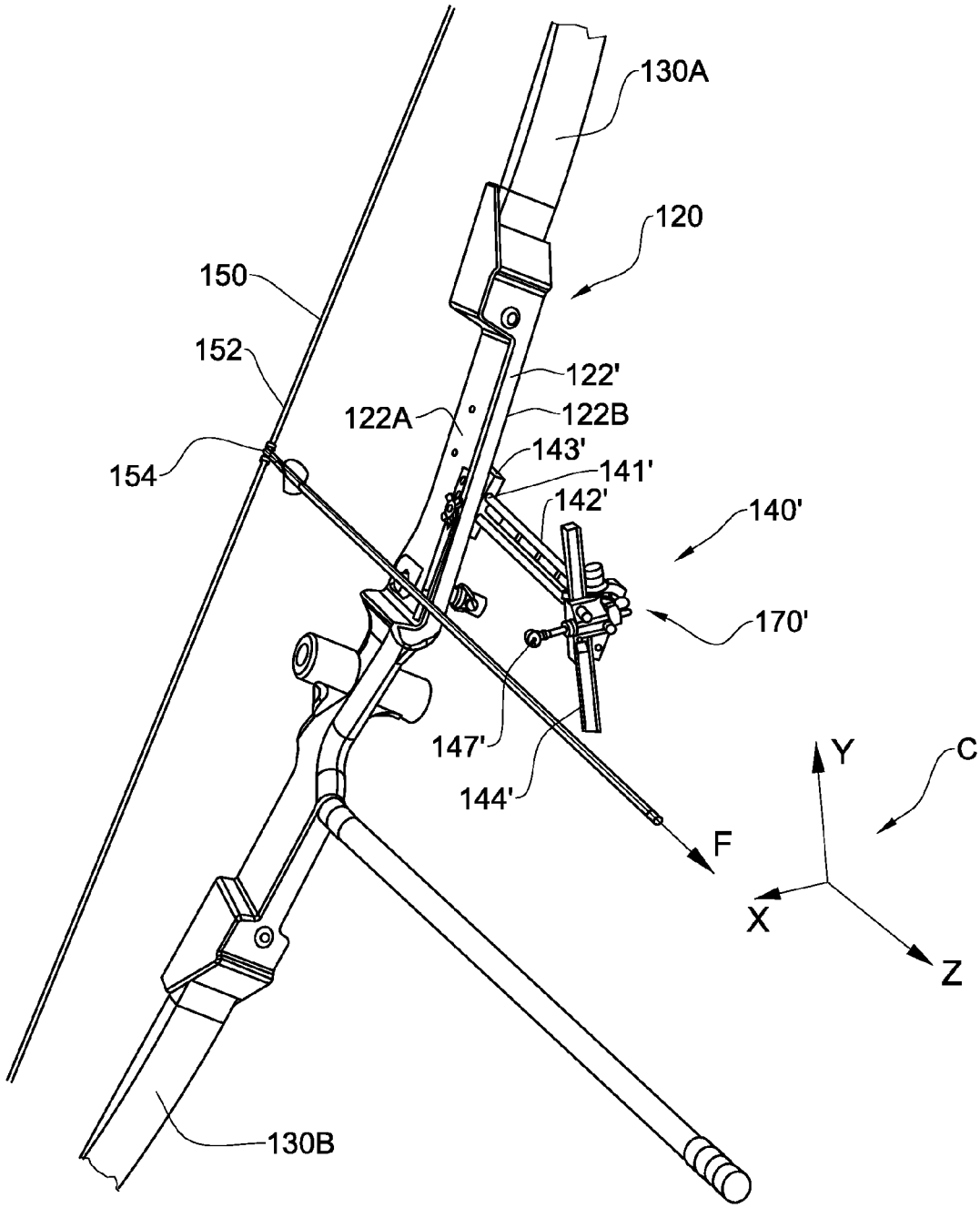
FIG. 9 is a partial isometric front/top/right side view of the embodiment of FIG. 8.

Referring to FIGS. 8 and 9 which illustrate an embodiment of the bow according to such an alternative variation, the integrated assembly, designated with reference numeral 140', is mounted to left hand side 122B of the upper part 122 of riser 120, which faces in a generally downward direction when the bow is tilted in a positive angle θ.

The integrated assembly 140' comprises a sight 147', which in this embodiment comprises a generally annular member, the open center of which is visually aligned with the target by the archer. In alternative variations of this embodiment, and/or in other embodiments, though, the sight may additionally or alternatively comprise cross-hairs, magnification lenses and so on, as in known in the art.

The position of sight 147' with respect to the upper part 122 may be adjusted by the archer along one or more of three mutually orthogonal axes x, y and z of coordinate axes system C. As before, axis z is generally parallel to the path F, axis y is generally aligned with the vertical direction, and axis x is orthogonal to axes y and z and is generally in a horizontal direction (though not to be confused with horizontal direction H which is instead defined on the vertical plane V, which is parallel to the y-z plane).

The integrated assembly 140' comprises a spacer arm 142', the aft end 141' thereof being affixed to the left side 122B of upper part 122 via clamping arrangement 143', and the relative position between spacer arm 142' and the of upper part 122 with respect to the z-axis being adjustably variable by means of said clamping arrangement 143'.

The forward end 145' of spacer arm 142' comprises an adjustable bracket arrangement 170' comprising a bracket plate 174', which is pivotable along a plane parallel to the x-y plane about pivot axis 173'. The bracket plate 174' comprises a rail member 149' that it is desired to be aligned with the y-axis in operation of the bow, when the central plane P thereof is tilted at a desired angle θ with respect to the vertical plane V, similarly to the case described above for the embodiment of FIGS. 5 to 7, mutatis mutandis. The bracket plate 174' further comprises an arcuate slot 179' centered on axis 173', and the adjustable bracket arrangement 170' comprises a pin (not shown) projecting from the forward end of forward end 145' and received in said slot 179'. Thus, as bracket plate 174' is pivotably rotated with respect to forward end 145', the pin moves along slot 179', and when the corresponding desired bracket angle Φ is achieved, the bracket plate 174' is locked in position with respect to upper part 122 by means of locking nut 171' that effectively clamps the bracket plate 174' between the forward end 145' and the nut 171'.

In the embodiment illustrated in FIGS. 8 and 9, the left hand side 122B of upper part 122 is substantially flat and substantially parallel to the central plane P of the bow. However, this need not necessarily be the case, and in alternative variations of this embodiment, and/or other embodiments, the upper part 122 may have any desired configuration, and the spacer arm 142' may be mounted to the upper part 122 in any desired manner and to any desired part thereof, and in such cases, the position of the central plane P with respect to the bracket plate 174' (i.e., the intersection of the central plane P, or of a plane parallel to plane P, with the bracket plate 174') is known and may optionally be marked at forward end 145' (for example as an etched or printed line thereon) to serve as a datum from which the desired bracket angle Φ is measured.

A shuttle member 146' is mounted on said rail member 149', and the position of the shuttle member 146' may be fixedly adjusted with respect to the rail member 149', and thus with respect to the y-axis, by means of clamp 146A' of the shuttle member 146'.

The sight 147' is carried by a transverse arm 148', which is mounted to and carried by shuttle member 146'. The position of the transverse arm 148' may be fixedly adjusted with respect to the shuttle member 146', and thus with respect to the x-axis, by means of clamp 146B' of the shuttle member 146'.

In alternative variations of this embodiment, and/or in other embodiments, the integrated assembly 140' may be suitably mounted on the right hand side 122A of the riser, which faces in a generally upward direction when the bow is tilted in a positive angle θ, mutatis mutandis.

In alternative variations of this embodiment, and/or in other embodiments, the integrated assembly may be non-adjustable, i.e., fixed, and thus provides a fixed tilt angle θ, i.e., enables a fixed tilting of the bow's central plane to be achieved by aligning a suitable datum surface of the bow, such as for example the aforementioned longitudinal edge 144', in the vertical direction. Thus, the tilt alignment arrangement 170' may be replaced with a non-adjustable wedge having a wedge angle corresponding to the desired bracket angle Φ (and thus tilt angle θ), and thus, alignment of the longitudinal edge 144' with the vertical plane V ensures that the central plane P is the corresponding tilt angle θ to the vertical plane V. This alternative variation of the integrated assembly may be configured for being mounted thereby to the right hand side 122A of the riser, which faces in a generally upward direction when the bow is tilted in a positive angle θ, or alternatively for being mounted thereby to the left hand side 122B of the riser, which faces in a generally downward direction when the bow is tilted in a positive angle θ.

Operation of the archery bow of FIGS. 1 to 6 according to one aspect of the invention directed to a method for archery will now be explained in particular with reference to FIGS. 5 to 7. Prior to shooting an arrow with the bow 100, a desired tilt angle θ between the central plane P of the bow 100 and the vertical plane V is chosen, and the corresponding (and substantially equal) bracket angle Φ is set by angularly displacing the movable plate 174 with respect to bracket base 172 about pivot axis 173. For example, the desired tilt angle θ may be 30°. Of course, once the desired tilt angle θ is set, there is no further need to manipulate the tilt alignment arrangement 170 until a different tilt angle θ is desired for the bow 100.

Operation of the archery bow according to the embodiment of FIGS. 8, 9 according to one aspect of the invention directed to a method for archery, is similar to that described above for the embodiment of FIGS. 1 to 6, mutatis mutandis.

Figure 11:
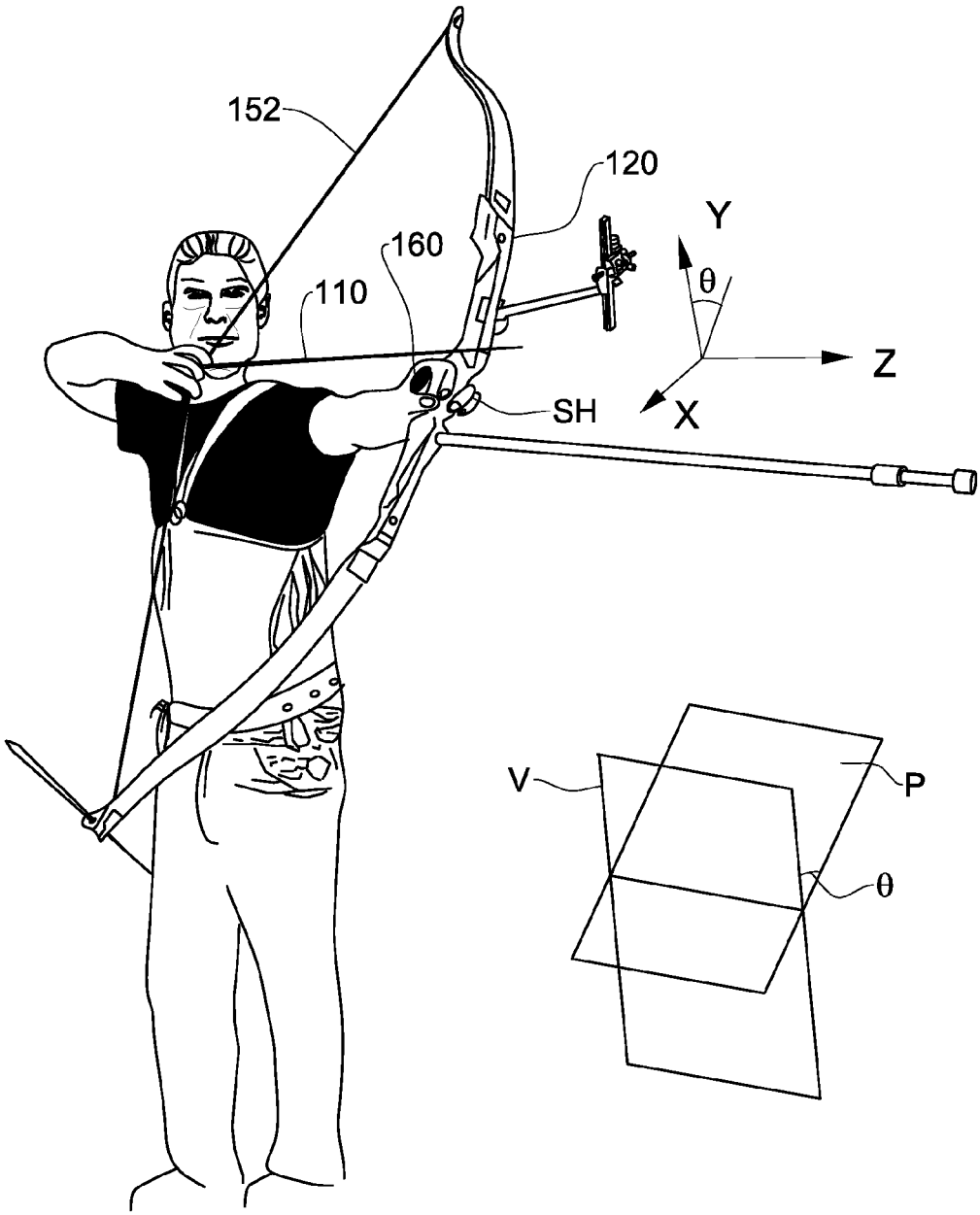
FIG. 11 illustrates an archer holding the embodiment of FIG. 8 in the shooting position.

Referring also to FIG. 11, the archer, who in this example is considered to be right handed, holds the bow riser 120 with the support hand SH, which in this case is the left hand, and adopts a sideways stance. In particular, the left arm (the support arm) is fully extended and the left hand grasps the handle 160, such that the small finger and ring finger are flexed and curled over the left finger grip 162, and the middle finger and the index finger are flexed and curled over the right finger grip 164, with the crotch between the middle finger and the ring finger firmly abutting the crotch-engaging portion 169. At the same time, the palm of the left hand is firmly rested onto the palm rest 165 and thus in a gently sloping position with respect to the horizontal plane. The left forearm is rotated in a supination direction so as to tilt the central plane P of the bow 100 until the longitudinal edge 144 is aligned vertically with the vertical plane V, which automatically results in the central plane P being tilted at tilt angle θ with respect to vertical plane V. This vertical alignment between the longitudinal edge 144 and the "imaginary" vertical plane V may be accomplished via pure visual estimation by the archer, or the archer may align this longitudinal edge 144 with any suitable vertical line (for example the edge of a building) in the archer's line of sight.

The arrow 110, which was previously loaded so that the shaft thereof is supported atop rest 184 and in contact with stop 182, is then drawn by pulling the center string serving 154 with the drawing hand, i.e., the right hand, with the arrow nock firmly held by the nock point 152.

At this point, and referring to FIG. 7 and FIG. 4*a* in particular, the net force T generated by the bow limbs 130A, 130B as the bowstring is drawn is resisted by the heel G of the palm of the support hand (which is opened and thus the fingers are not grasping the handle) and support arm of the archer, and are thus generally aligned with a sagittal plane of the archer, which is substantially parallel to the vertical plane V. The direction of the force T is thus through the wrist, and little or no torque is applied to the wrist joint or elbow joint. The arrow can then be aimed and subsequently released, and the tactile feedback provided by the control portion 125 in contact with the open inner fingers enables the archer to perceive the relative position and orientation of the bow with respect to the archer, and to effect fine adjustments to this relative position and orientation.

A feature of this method for archery is that the line of force T as resisted by the archer thus passes through the heel of the palm, the forearm, elbow and shoulder of the support arm holding the bow, without the need to bend the arm or wrist to avoid impact of arrow or the bowstring on the support arm. Instead, the support arm is effectively laterally spaced from the path F of the arrow by the tilting of central plane P with respect to the vertical plane V, and also by having the arrow supported on the riser on the side of the riser that is facing away from the support hand, i.e., on the right side of the right-handed riser. Another feature of this method for archery is that the limited outward rotation of the wrist of the support arm to provide the tilt angle θ helps to further minimizes or eliminate torque on the wrist when the bow is used.

According to other aspects of the invention, the bow may be used for shooting an arrow when the central plane P is fully aligned with the desired vertical plane V, or when fully aligned with the horizontal plane, mutatis mutandis.

Figure 10:
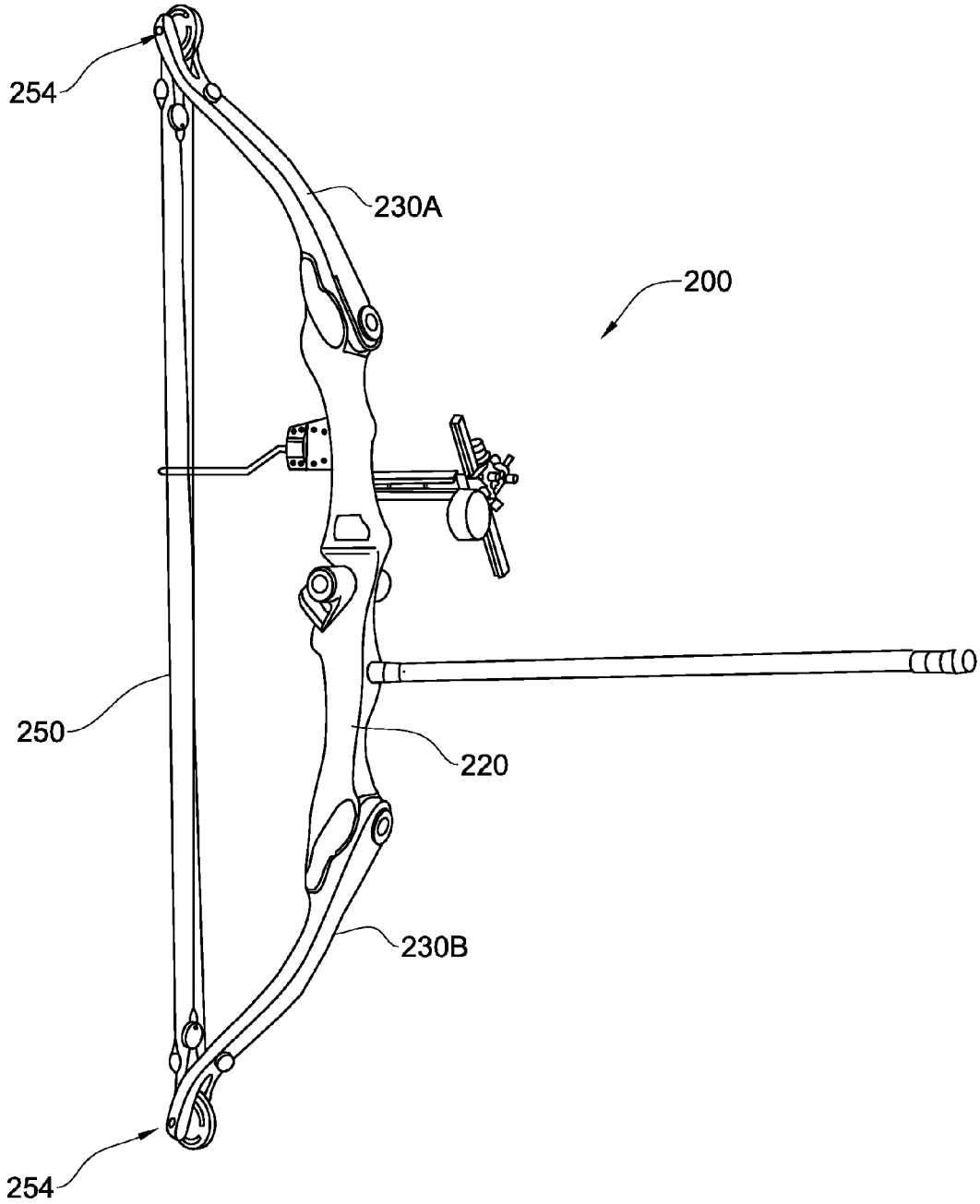
FIG. 10 is a side view of a bow according to a second embodiment of the invention.

Referring to FIG. 10, a second embodiment of the archery bow, designated herein with the reference numeral 200, comprises all the features and elements of, and may be used in a similar manner to, the embodiment disclosed above with respect to FIGS. 1 to 9, mutatis mutandis, with the main difference that the archery bow 200 is configured as a compound bow rather than as a recurve bow. Accordingly, while bow 200 comprises limbs 230A, 230B and riser 220, substantially similar to the limbs 130A, 130B and riser 120 of bow 100 as disclosed herein, mutatis mutandis, bow 200 additionally comprises a conventional pulley arrangement 259 and bowstring 250, rather than the recurve bowstring 150 of the first embodiment, mutatis mutandis.

A third embodiment of the archery bow (not shown) comprises all the features and elements of, and may be used in a similar manner to, the embodiment disclosed above with respect to FIGS. 1 to 9, mutatis mutandis, with the main difference that the archery bow according to the third embodiment is configured as a long bow rather than as a recurve bow. Accordingly, while bow according to the third embodiment also comprises limbs and a riser, substantially similar to the limbs 130A, 130B and riser 120 of bow 100 as disclosed herein, mutatis mutandis, the long bow according to the third embodiment comprises free ends of the limbs characteristic of long bows, rather than the recurve free ends of the first embodiment, mutatis mutandis.

While the above embodiments have been described for a right-handed bow, in which a right-handed archer grasps the respective riser with the left hand, corresponding alternative embodiment (not illustrated) of a left-handed bow for a left-handed archer comprises all the elements and features of, and may be used in a similar manner to, the above embodiments, mutatis mutandis, with the main difference that such a left-handed bow is essentially a mirror image of, but otherwise substantially similar to, the respective right handed bow herein described, mutatis mutandis, and its respective riser is thus grasped by the right hand of the archer, which is now the support hand of the archer.

In the method claims that follow, alphanumeric characters and Roman numerals used to designate claim steps are provided for convenience only and do not imply any particular order of performing the steps.

Finally, it should be noted that the word "comprising" as used throughout the appended claims is to be interpreted to mean "including but not limited to".

While there has been shown and disclosed example embodiments in accordance with the invention, it will be appreciated that many changes may be made therein without departing from the spirit of the invention.

The invention claimed is:

1. Bow riser for an archery bow, comprising a handle configured for enabling said bow riser to be held in a shooting position by a support hand of an archer, said riser comprising a longitudinal, axis and having a first lateral side corresponding to a first side of the archer including the support hand, and a second lateral side corresponding to, a second side of the archer including the drawing hand, the archery bow having a central plane associated therewith, said handle comprising a palm rest comprising a pivot zone and configured, at least during shooting with the bow, for enabling the palm of the support hand to be rested on said palm rest while concurrently enabling the fingers of the support hand to be fully open, and for transmitting bow loads with respect to the palm at said pivot zone;

wherein said riser is configured for placing an arrow in a shooting position in lateral facing relationship with said second lateral side, and wherein said riser comprises a finger separating portion above said palm rest, said, finger separating portion being generally aligned with a central plane of the bow, said finger separating portion being configured for laterally separating the fingers of the support hand into two groups when the palm of the support hand is rested on said palm rest, each said group including at least one finger other than the thumb of the support hand.

2. Bow riser according to claim 1, wherein said finger separating portion is generally aligned with the central plane of the bow.

3. Bow riser according to claim 1, further comprising a vertical alignment arrangement configured for enabling repeatably tilting the central plane of the bow with respect to a desired vertical plane at a desired tilt angle.

4. Bow riser according to claim 1, further comprising a sight arrangement for aiming the bow.

5. Archery bow, comprising a bow riser as defined in claim 1.

6. Archery bow according to claim 5 further comprising a tilt alignment apparatus for said archery bow, wherein the alignment apparatus is configured for enabling repeatably tilting a central plane of the archery bow with respect to a desired vertical plane at a desired tilt angle.

7. Archery bow according to claim 6, wherein the tilt alignment apparatus further comprising a visual indicator configured for providing a visual datum alignment axis to the archer, said visual indicator being configured for enabling said visual datum alignment axis to be selectively visually aligned with respect to the desired vertical plane by the archer, wherein said visual datum alignment axis is set at said desired tilt angle with respect to the central plane of the bow.

8. Archery bow according to claim 6, wherein the vertical alignment arrangement of the tilt alignment apparatus is configured for enabling said desired tilt angle to be selectively varied within a range of said desired tilt angles.

9. Archery bow according to claim 6, wherein the tilt alignment apparatus further comprising a sight arrangement for aiming the bow, and wherein said sight arrangement is mounted onto the archery bow via said vertical alignment arrangement.

10. Bow riser for an archery bow, comprising a handle configured for enabling said bow riser to be held in a shooting position by a support hand of an archer, said riser comprising a longitudinal axis and having a first lateral side corresponding to a first side of the archer including the support hand, and a second lateral side corresponding to a second side of the archer including the drawing hand, the archery bow having a central plane associated therewith, said handle comprising a palm rest comprising a pivot zone and configured, at least during shooting with the bow, for enabling the palm of the support hand to be rested on said palm rest while concurrently enabling the fingers of the support hand to be fully open, and for transmitting bow loads with respect to the palm at said pivot zone;

wherein said riser is configured for placing an arrow in a shooting position in lateral facing relationship with said second lateral side, and wherein said palm rest is positioned generally centrally on, said riser with respect to said first lateral side and said second lateral side.

11. Bow riser for an archery bow, comprising a handle configured for enabling said bow riser to be held in a shooting position by a support hand of an archer, said riser comprising a longitudinal axis and having a first lateral side corresponding to a first side of the archer including the support hand, and a second lateral side corresponding to a second side of the archer including the drawing hand, the archery bow having a central plane associated therewith, said handle comprising a palm rest comprising a pivot zone and configured, at least during shooting with the bow, for enabling the palm of the support hand to be rested on said palm rest while concurrently enabling the fingers of the support hand to, be fully open, and for transmitting bow loads with respect to the palm at said pivot zone;

wherein said riser is configured for placing an arrow in a shooting position in lateral facing relationship with said second lateral side, and wherein said pivot zone is positioned generally symmetrically with respect to the central plane of the bow.

12. Bow riser for an archery bow, comprising a handle configured for enabling said bow riser to be held in a shooting position by a support hand of an archer, said riser comprising a longitudinal axis and having a first lateral side corresponding to a first side of the archer including the support hand, and a second lateral side corresponding to a second side of the archer including the drawing hand, the archery bow having a central plane associated therewith, said handle comprising a palm rest comprising a pivot zone and configured, at least during shooting with the bow, for enabling the palm of the support hand to be rested on said palm rest while concurrently enabling the fingers of the support hand to be fully open, and for transmitting bow loads with respect to the palm at said pivot zone;

wherein said riser is configured for placing an arrow in a shooting position in lateral facing relationship with said second lateral side, and wherein said palm rest is configured for aligning a back of the support hand with the support forearm to minimize or eliminate extension of the wrist of the support arm of the archer.

13. Bow riser for an archery bow, comprising a handle configured for enabling said bow riser to be held in a shooting position by a support hand of an archer, said riser comprising a longitudinal axis and having a first lateral side corresponding to a first side of the archer including the support hand, and a second lateral side corresponding to a second side of the archer including the drawing hand, the archery bow having a central plane associated therewith, said handle comprising a palm rest comprising a pivot zone and configured, at least during, shooting with the bow, for enabling the palm of the support hand to be rested on said palm rest while concurrently enabling the fingers of the support hand to be fully open, and for transmitting bow loads with respect to the palm at said pivot zone;

wherein said riser is configured for placing an arrow in a shooting position in lateral facing relationship with said second lateral side, and wherein said palm rest comprises a generally convex body projecting in a generally aft, direction from the riser.

14. Bow riser for an archery bow, comprising a handle configured for enabling said bow riser to be held in a shooting position by a support hand of an archer, said riser comprising a longitudinal axis and having a first lateral side corresponding to a first side of the archer including the support hand, and a second lateral side corresponding to a second side of the archer including the drawing hand, the archery bow having a central plane associated therewith, said handle comprising a palm rest comprising a pivot zone and configured, at least during shooting with the bow, for enabling the palm of the support hand to be rested on said palm rest while concurrently enabling the fingers of the support hand to be fully open, and for transmitting bow loads with respect to the palm at said pivot zone;

wherein said riser is configured for placing an arrow in a shooting position in lateral facing relationship with said second lateral side, and said riser further comprising a first finger grip and a second finger grip, said finger grips extending laterally in mutually opposite directions with respect to the central plane, wherein in use, each said finger grip is configured for being independently gripped by a separate group of adjacent fingers of the bow support hand of an archer.

15. Bow riser according to claim 14, further comprising a finger crotch engaging portion, said finger crotch engaging portion being generally comprised on an aft longitudinal portion of said finger separating portion, wherein in use said crotch-engaging portion is engagingly abutting a crotch between said two groups of fingers in load bearing contact while each said finger grip may be concurrently gripped by a separate group of adjacent fingers of the bow support hand of an archer.

16. Method for archery using an archery bow, the archery bow being configured to be held in at least during shooting by a support hand of an archer, the archery bow comprising a longitudinal axis and having a first lateral side corresponding to a first side of the archer including the support hand, and a second lateral side corresponding to a second side of the archer including the drawing hand, the archery bow having a central plane associated therewith, the method comprising:

(a) holding the archery bow with the holding hand and drawing the bowstring of the archery bow together with an arrow with the drawing hand to the fully drawn position, aiming and shooting the arrow;

(b) at least during shooting of the arrow, supporting bow loads with respect to the palm of the support hand via a pivot zone of a palm rest of the archery bow while concurrently maintaining open the fingers of the support hand;

(c) wherein at least in said fully drawn position, the arrow is in lateral facing relationship with the second lateral side of the archery bow;

wherein the archery bow has a bow riser comprising a handle configured for enabling said bow riser to be held in a shooting position by a support hand of an archer, said riser comprising a longitudinal axis and having a first lateral side corresponding to a first side of the archer including the support hand, and a second lateral side corresponding to a second side of the archer including the drawing hand, the archery bow having a central plane associated therewith, said handle comprising a palm rest comprising a pivot zone and configured, at least during shooting with the bow for enabling the palm of the support hand to be rested on said palm rest while concurrently enabling the fingers of the support hand to be fully open, and for transmitting bow loads with respect to the palm at said pivot zone; and wherein said riser is configured for placing an arrow in a shooting position in lateral facing relationship with said second lateral side, and wherein said riser comprises a finger separating portion above said palm rest, said finger separating portion being generally aligned with a central plane of the bow, said finger separating portion being configured for laterally separating the fingers of the support hand into two groups when the palm of the support hand is rested on said palm rest, each said group including at least one finger other than the thumb of the support hand.

17. Method according to claim 16, wherein the palm of the support hand is in generally orthogonal relationship to the central plane of the bow.

18. Method according to claim 16, further comprising tilting the archery bow to provide a desired tilt angle between the central plane of the archery bow and a desired vertical plane, and maintaining said tilt angle at least during shooting of the arrow, wherein said tilt angle is greater than 0° and less than 90°.

19. Method according to claim 16, wherein said vertical plane corresponds to a sagittal plane of the archer.

* * * * *